United States Patent [19]

DiMatteo et al.

[11] Patent Number: 4,819,283

[45] **Date of Patent: * Apr. 11, 1989**

[54] INVALID TRANSFER ARRANGEMENT

[75] Inventors: Paul DiMatteo, Dix Hills; Charles F. Chubb, Brookville; Robert Segnini, Stony Brook, all of N.Y.

[73] Assignee: Nova Technologies Inc., Hauppauge, N.Y.

[ * ] Notice: The portion of the term of this patent subsequent to Feb. 23, 2005 has been disclaimed.

[21] Appl. No.: 937,015

[22] Filed: Dec. 2, 1986

Related U.S. Application Data

[63] Continuation-in-part of Ser. No. 731,533, May 7, 1985, Pat. No. 4,776,047.

[51] Int. Cl.[4] ..... A61G 7/08

[52] U.S. Cl. ..... 5/81 R; 5/81 B

[58] Field of Search ..... 5/66, 67, 81 R, 81 C, 5/83, 86, 90; 297/330, DIG. 4

[56] References Cited

U.S. PATENT DOCUMENTS

| | | | |
|---|---|---|---|
| 805,805 | 11/1905 | Loose | 5/81 R |
| 4,247,091 | 1/1981 | Glowacki et al. | 5/66 X |
| 4,679,259 | 7/1987 | DiMatteo et al. | 5/81 C X |
| 4,726,082 | 2/1988 | DiMatteo et al. | 5/81 R |

FOREIGN PATENT DOCUMENTS

| | | | |
|---|---|---|---|
| 0172296 | 2/1986 | European Pat. Off. | 5/81 R |

*Primary Examiner*—Alexander Grosz
*Assistant Examiner*—Michael F. Trettel
*Attorney, Agent, or Firm*—Max Fogiel

[57] ABSTRACT

An arrangement of a wheelchair with a movable seat and leg rest and a bed equipped with transfer apparatus provided with rollers, a movable sheet and lift arms, for transporting an invalid comfortably across the bed to a sitting position in the wheelchair. The invalid can also be transferred to a standing position at the end of the bed.

46 Claims, 33 Drawing Sheets

VIEW A-A / B-B

INVALID TRANSFER ARRANGEMENT

BACKGROUND OF THE INVENTION

The present application is a continuation-in-part of the parent application Ser. No. 731,533 filed May 7, 1985 now U.S. Pat. No. 4,776,047.

The process of transferring an invalid person from a bed to a wheelchair or commode often requires the help of two or more assistants. The task frequently requires considerable strength and is a common source of injury to the person being transferred or to the nurse(s) or attendant(s) doing the transfer. These problems often are the major factors that require a patient to be hospitalized or moved to a nursing home, rather than being cared for at home. They also increase the cost of caring for persons in hospitals and nursing homes.

SUMMARY OF THE INVENTION

The parent application describes an arrangement for transferring an invalid person from a bed to a separate horizontal surface by means of a sheet which was pulled over the surface of the mattress by being rolled up on a roller at the foot of the bed and unrolled from a roller at the head of the bed. Accordingly, it is the primary object of the present invention to provide a special wheelchair, which may be a commode or may be convertible to a commode, and a bed equipped with rollers, a transport sheet, and a lifting mechanism, so that a person can be comfortably transported over the bed and partially onto the horizontal seat of the wheelchair and then raised to a normal sitting position thereon, with no effort on the part of the invalid person and requiring minimal physical strength or skill on the part of an attendant.

In many cases invalid persons can easily be injured when they are being transferred between a bed and a wheelchair, due to such causes as stresses placed on weak bones or decubitus ulcers, or as a result of accidental falling. Accordingly, it is another object of this invention to provide a comfortable and safe method of transfer with minimum stress on the person's body and minimum sliding action which could cause or aggravate decubitus ulcers.

It is still another object of the present invention to provide apparatus which can be installed on existing hospital or home-type beds so that a person can be comfortably transported to a seated position on a wheelchair or a commode, or a toilet at the end of the bed, or to a standing position on the floor.

A further object is to pull a semi-reclining person who has slid down in the bed up to a comfortable position. This is a frequent and stressful task for nurses and attendants.

Additional objects and advantages of the present invention will become evident from the following description of specific embodiments when read in connection with the accompanying drawings.

It is to be understood that the term wheelchair, as used herein, includes commodes.

This present invention is also applicable to transfer onto fixed chairs and seating, such as toilets, and there is no intent to limit the present invention to transfer between a bed and a wheelchair.

DESCRIPTION OF THE PREFERRED EMBODIMENTS

FIGS. 1*a* through 1*h* schematically illustrate the method used to transport a person from a wheelchair to a bed.

Figure 1A:
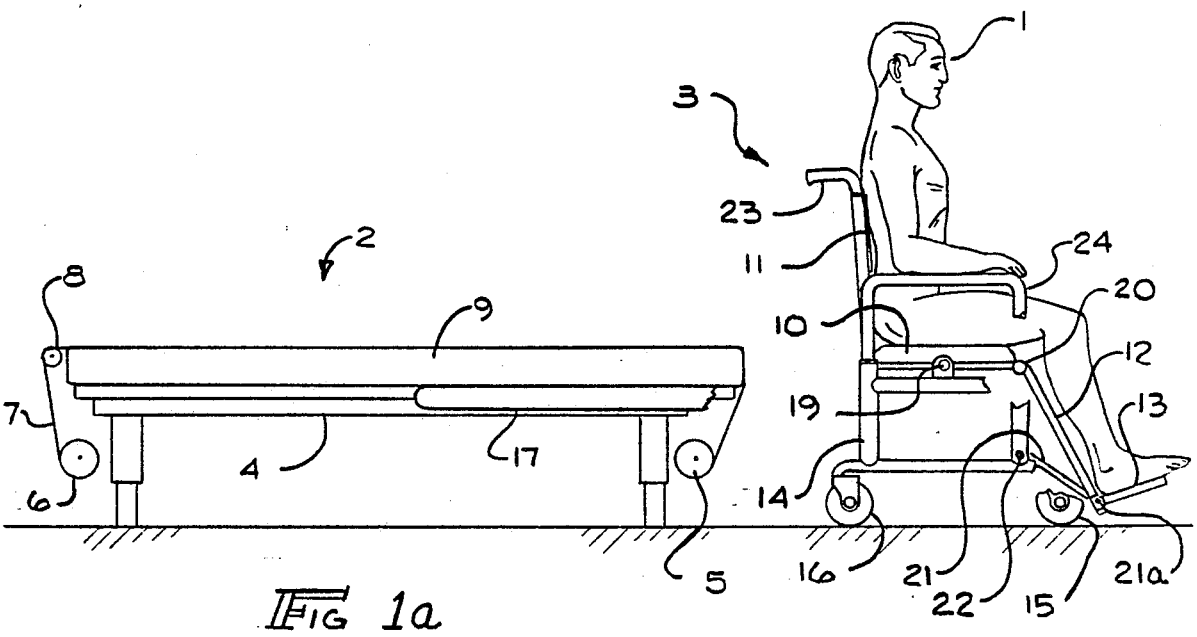
FIGS. 1*a* through 1*h* are schematic sequential views showing the transfer of a person from a wheelchair to a bed.

FIG. 1*a* shows the person 1 seated in a wheelchair 3 ready to be transferred to bed 2. Bed 2 consists of a conventional bed 4, as found in a home or institution such as a nursing home or hospital, with modifications to be described. The bed is presumed to be adjusted by conventional means (not shown) to the proper height to perform the required operations.

Attached to the bed 4 is an arrangement for transporting a person longitudinally across the bed. This arrangement contains a front roller 5 (shown in FIG. 1*a*) whose length is approximately equal to the width of the bed, and which is mounted at the foot-end of the bed. A similar rear roller 6 is positioned at the head-end of the bed. (Head and foot are seen from the patient's point of view.) A transport sheet 7, approximately equal in width to the width of the bed and significantly longer than the bed, is fastened to and partially rolled up on the front roller 5 while the other end is fastened to and partially rolled up on the rear roller 6 at the head-end of the bed. Transport sheet 7 passes over a supporting idler roller 8 between the mattress 9 and rear roller 6.

Electric motors, as described later, or hand cranks provide mechanical power for driving the two rollers 5 and 6 to wind up the transport sheet 7 on one roller while allowing it to unwind from the other so as to move the sheet, and to thereby transport a person reclining thereon, across the surface of the mattress This particular arrangement of rollers is shown to help illustrate the principles of this invention, but the invention is not limited to this configuration, and other arrangements for moving a sheet across a bed to transport a person over the bed can be used equally well.

Also attached to the bed 4, by means not shown, are a pair of mattress lift arms 17, which are described later.

The wheelchair 3 contains a frame 14 supported on front wheels 15 and rear wheels 16, all of which are depicted as small in size. Either pair may be on casters or fixed axles, or the front pair may be large with fixed axles with the other pair on casters. The wheelchair back rest 11, with hand grips 23, is removably mounted as described later. The seat 10 is rotatably mounted on each side to the frame 14 through seat pivots 19 and is connected to the top of the leg rest 12 through knee hinge 20. The bottom of leg rest 12 is similarly attached on each side to links 21 through foot pivots 21*a*, and the other ends of links 21 are attached to frame 14 by link pivots 22. The operation of this four bar linkage formed by the frame 14, links 21, leg rest 12 and seat 10 is described later. The seat 10 is latched securely in the normal seating position shown, except during transfer operation. Foot rest 13 is attached to leg rest 12. Optional arm rests 24 are movably attached to frame 14.

Figure 1B:
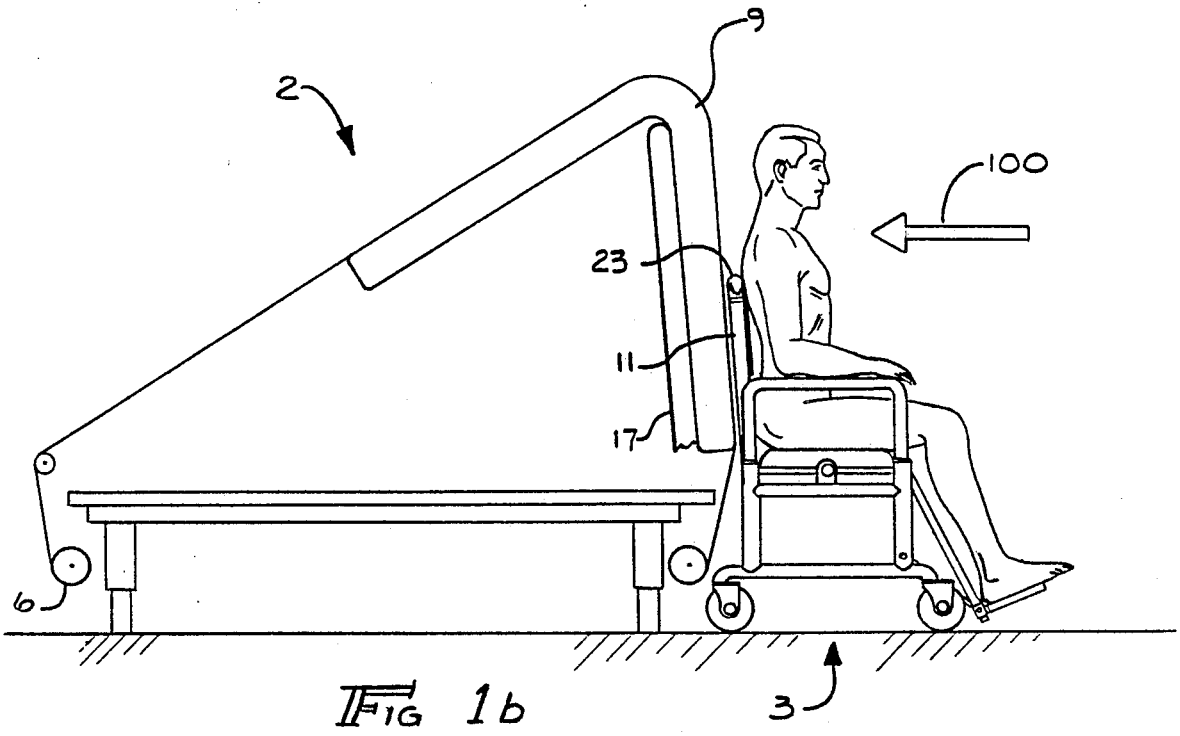

FIG. 1*b* shows the initial transfer steps. The wheelchair hand grips 23 have been manually rotated outwards to unlock the back rest 11. The wheelchair 3 has been pushed back, as shown by arrow 100, and latched (by means shown later) to the end of bed 2. The lift arms 17 have been rotated to lift up the mattress 9 to approximately 85 degrees, as shown, with the sheet unrolled as needed from head-end roller 6.

Figure 1C:
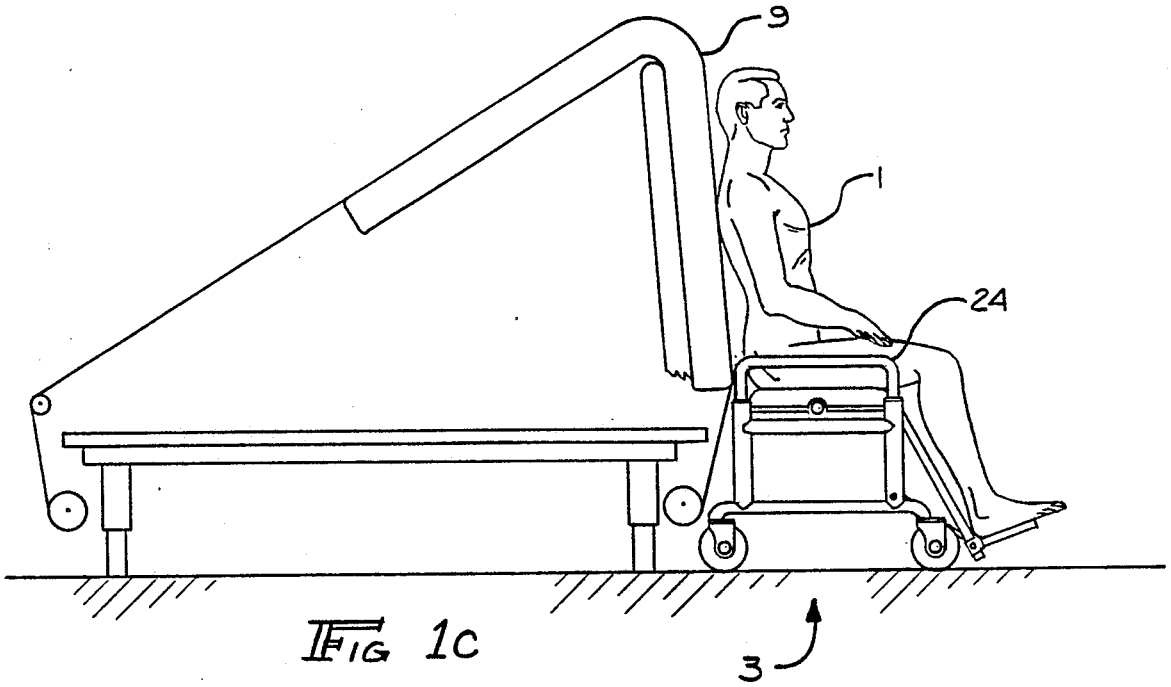

FIG. 1*c* shows the chair 3 with the back rest 11 removed so that the person 1 is resting directly against the mattress 9. The back rest 11 may be completely removed, as shown, or may be lowered, pivoted to the side, or otherwise taken out from behind the person's back. Arm rests 24 have been moved down as shown or otherwise moved away from obstructing the transfer of the person 1. At this time, the seat latch (shown later) is released, by removal of the back rest 11, by movement of the arm rests 24, or by a separate manual operation.

Figure 1D:
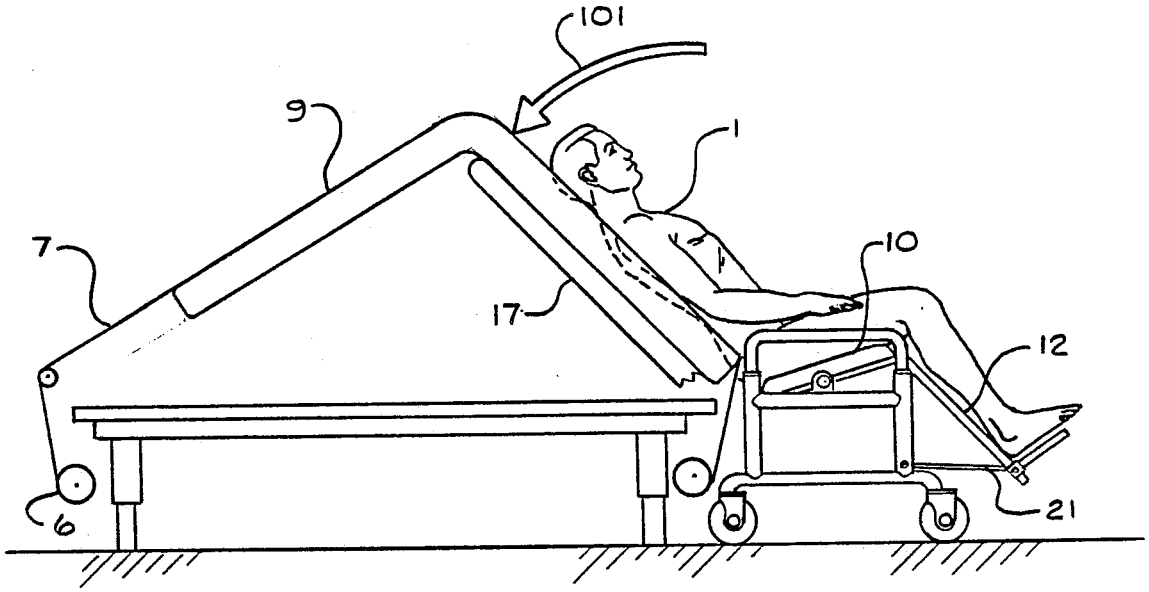

FIG. 1*d* shows the beginning of the actual transfer of the patient by the action of lowering the mattress lift arms 17 which lower the person 1 toward a reclining position as shown by arrow 101. As his weight shifts back toward the bed, the seat 10 pivots up thereby lifting the leg rest 12 and links 21. The lifting action is aided by a spring (not shown) which counteracts the normal weight of the leg rest 12 and the person's legs. A one-way seat latch shown in a later figure, or other means, prevents the seat from rotating beyond approximately 30 degrees to prevent excessive seat rotation which could cause the person to become wedged between the mattress 9 and seat 10. As mattress 9 is lowered, the rear roller 6 is driven to take up slack in the transport sheet 7.

Figure 1E:
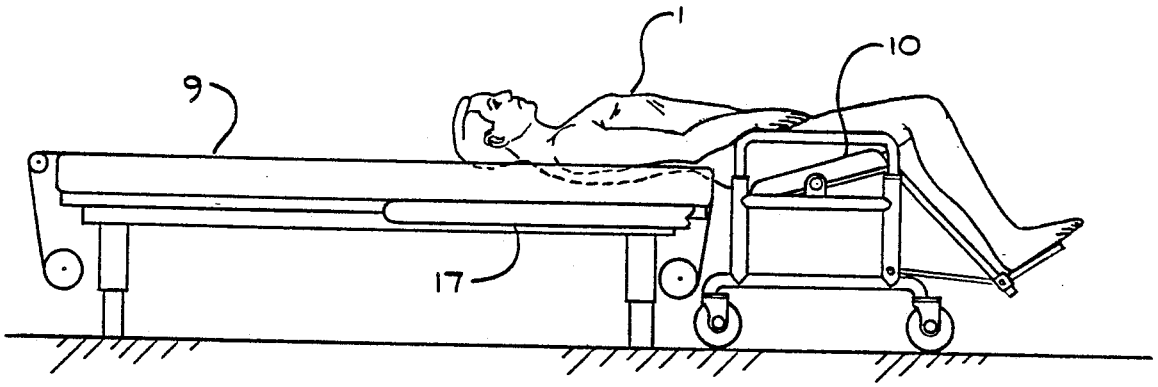

FIG. 1*e* shows the mattress lift arms 17 in their lowered position with the person 1 reclining, partly on the mattress 9. When the lift arms drop below approximately 20 degrees tilt, the one-way seat latch is automatically released and the seat 10 is free to rotate further.

Figure 1F:
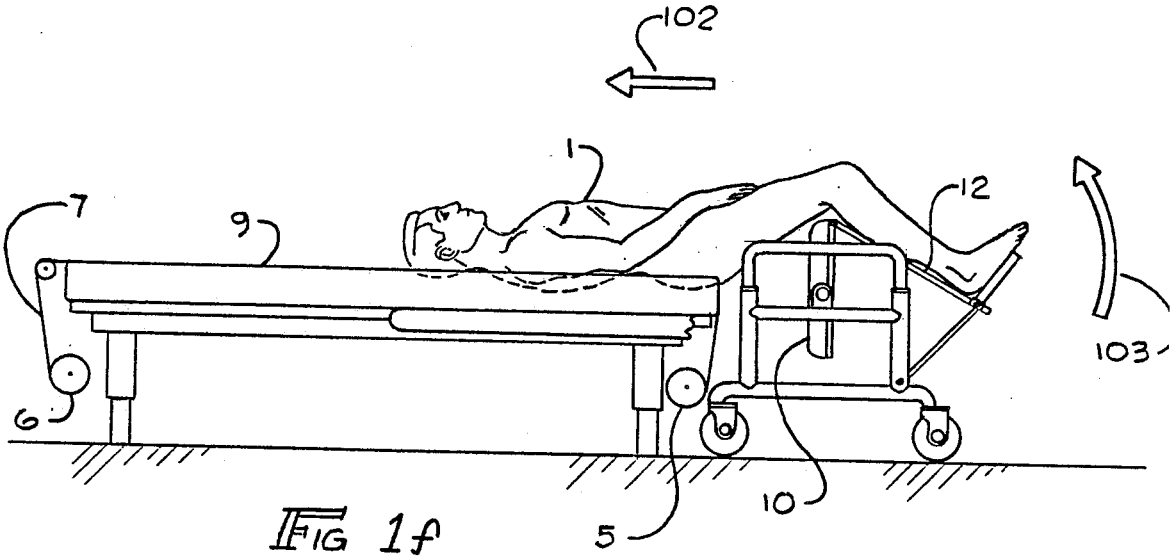

FIG. 1*f* shows, by arrows 102 and 103, the action of the sheet 7 in pulling the person 1 onto mattress 9 as rear roller 6 is driven to wind up sheet 7, drawing it across the mattress 9 from front roller 5. The seat 10 continues to rotate freely, and leg rest 12 is drawn around as shown.

Figure 1G:
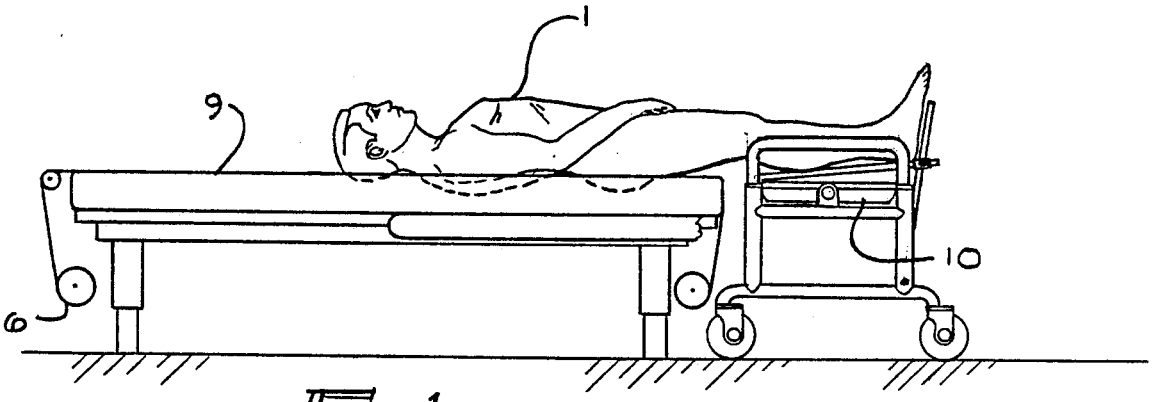
Figure 1H:
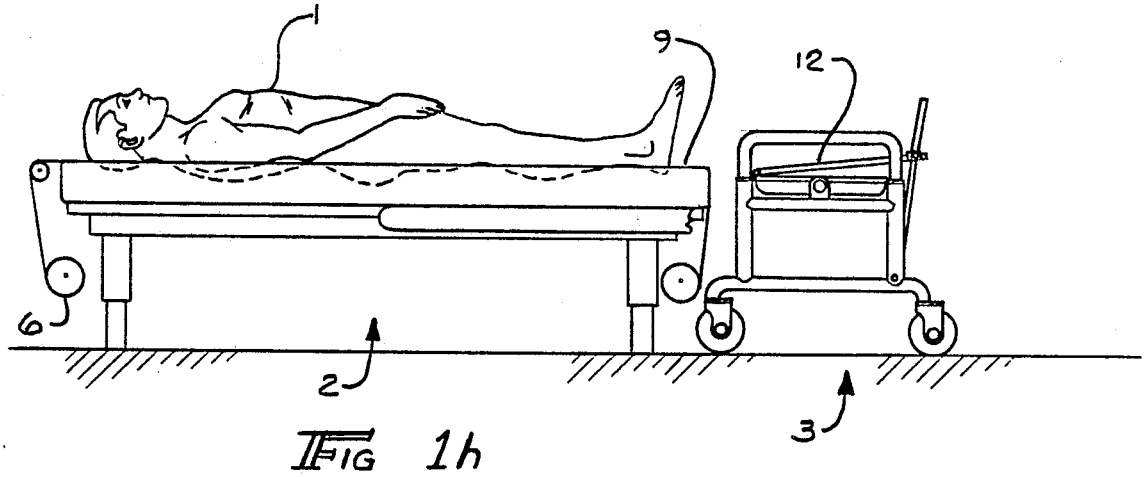

FIG. 1*g* shows seat 10 completely rotated to 180 degrees. Rear roller 6 continues to move the person 1 until he reaches the middle of the mattress 9, as shown in FIG. 1*h*. His feet and legs slide across the folded leg rest 12, which is soft and covered with a smooth slippery material such as nylon, to prevent skin irritation. The wheelchair 3 can then be unlatched and removed from the bed 2, if desired.

FIGS. 2*a* through 2*h* schematically illustrate the method used to transfer a person from a bed to a wheelchair.

Figure 2A:
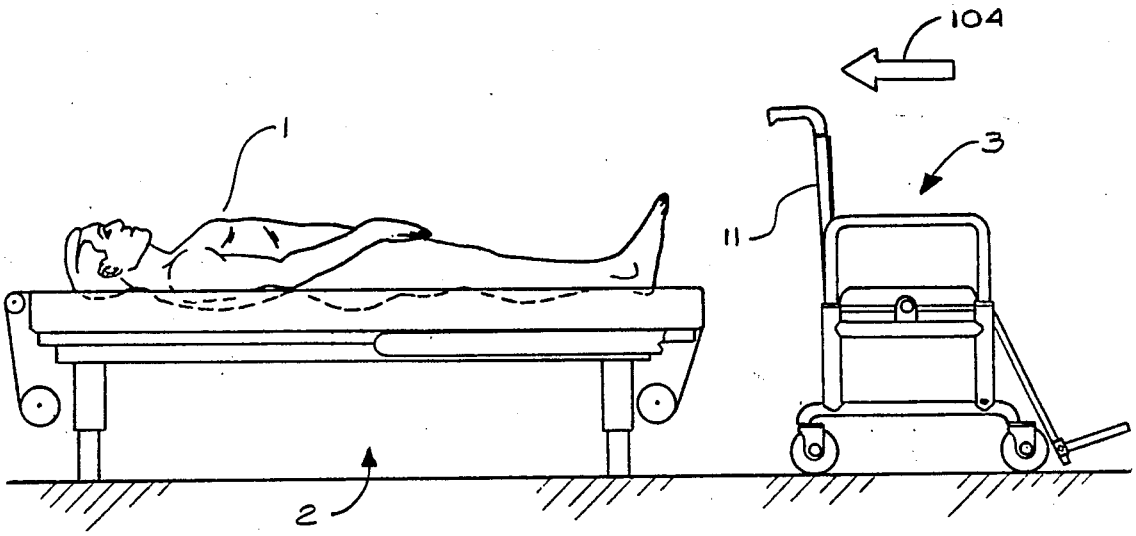
FIGS. 2*a* through 2*i* are similar schematic sequential views showing transfer from a bed onto a wheelchair.

FIG. 2*a* shows the person 1 reclining on the bed 2, with the wheelchair 3 in its normal seating position with back rest 11 in place. Wheelchair 3 is first moved toward bed 2, as shown by arrow 104.

Figure 2B:
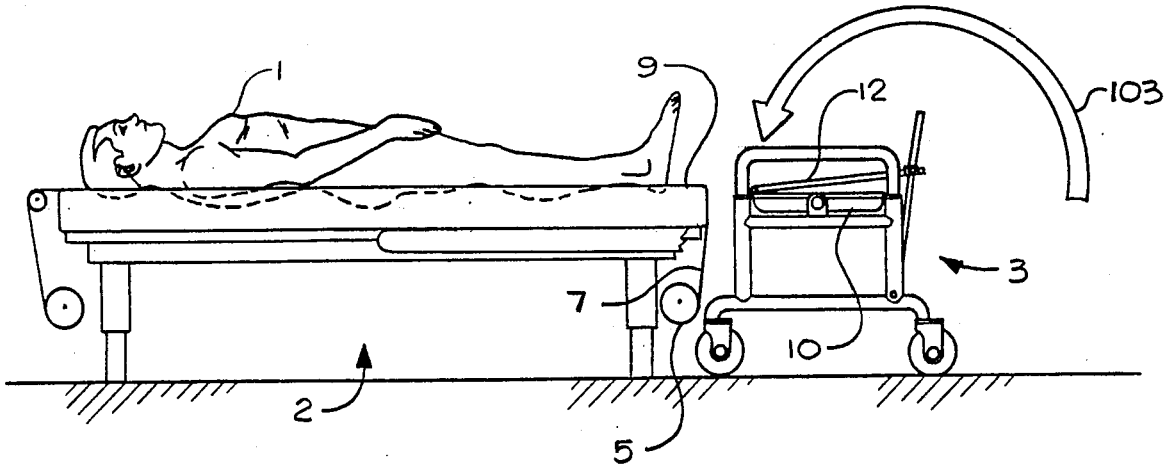

FIG. 2*b* shows the wheelchair 3 after it has been latched to the bed 2, its back rest 11 removed and its seat 10 manually unlatched and fully rotated as shown by arrow 103 with the leg rest 12 in position for patient transfer. At this point, front roller 5 will be driven to wind up transport sheet 7 and draw the person 1 across mattress 9.

Figure 2C:
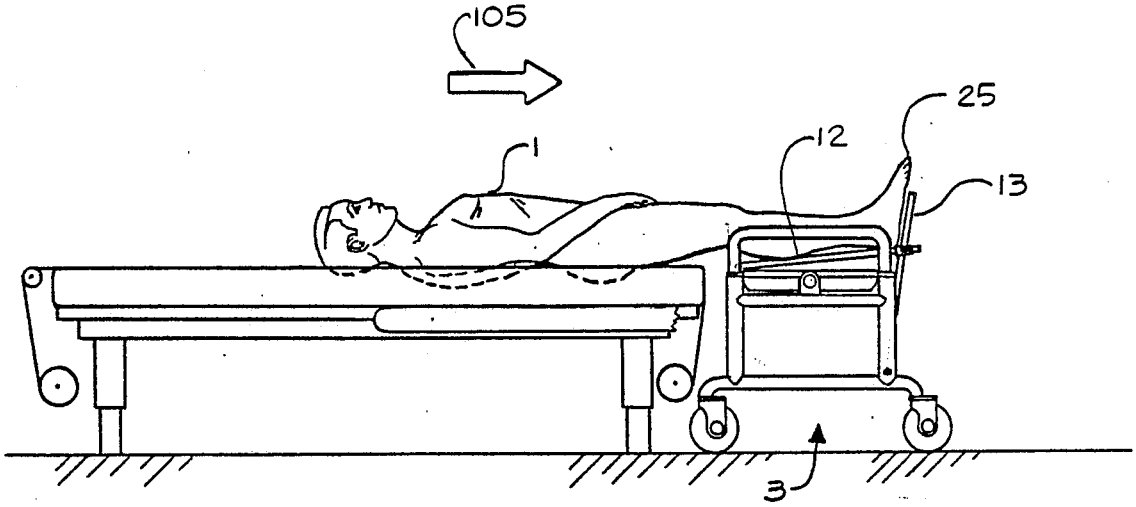

FIG. 2*c* shows the patient 1 after he has been transported in the direction of arrow 105 part way onto the chair 3 with his feet and legs sliding across leg rest 12 and his feet 25 about to contact foot rest 13.

Figure 2D:
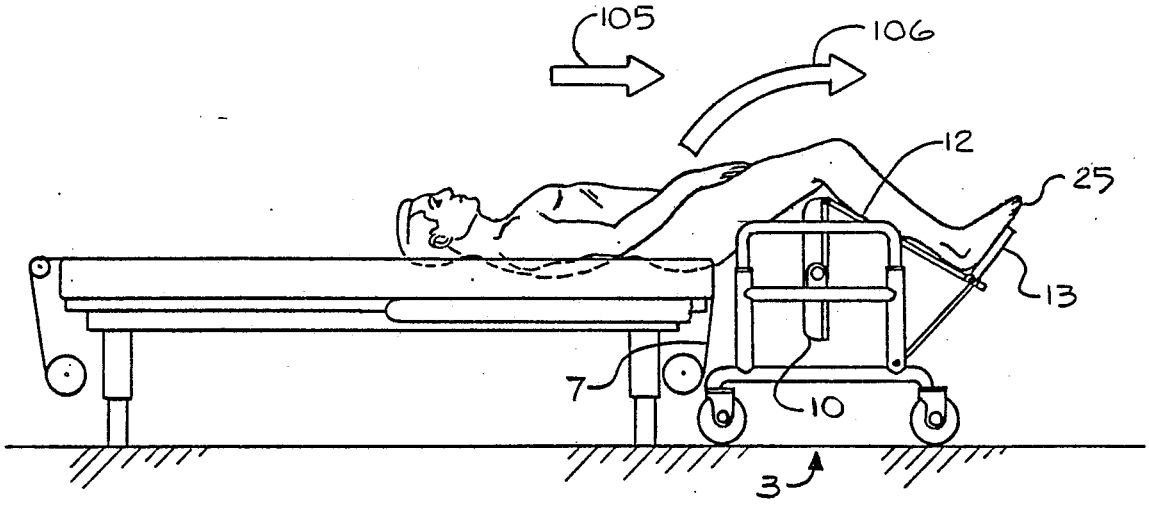

FIG. 2*d* shows that pressure from the person's feet 25 on the foot rest 13 causes the seat 10 and leg rest 12 to rotate with arrow 106, as transport sheet 7 carries the person further onto the wheelchair 3 in the direction of arrow 105.

Figure 2E:
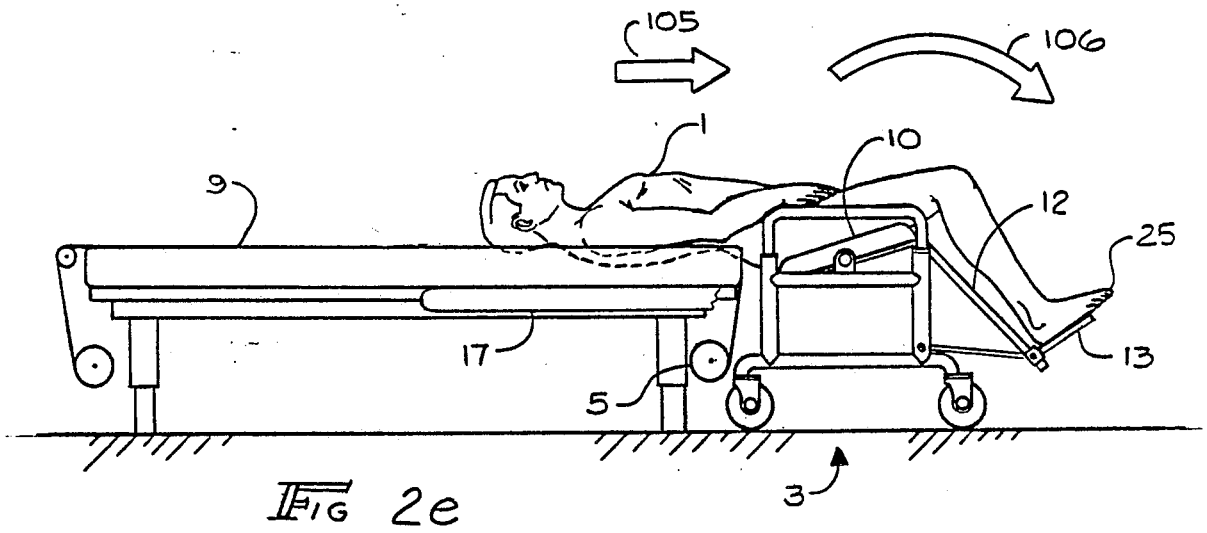

FIG. 2*e* shows that a the person 1 is carried further onto the wheelchair 3 in the direction of arrow 105, the seat 10 rotates under him in the direction of arrow 106 so that his buttocks move far enough onto the seat 10 for comfortable seating. The position of the person 1 on the seat is primarily determined by the length of the leg rest 12 between seat 10 and foot rest 13. This length determines how far the person is carried onto the wheelchair 3 before his feet 25 reach the foot rest 13 and cause the seat 10 to rotate. Foot rest 13 is fastened by bolts (not shown) passing through slots in leg rest 12 which enable the leg rest length to be adjusted to optimize the final positioning of person 1 on seat 10.

When the person 1 is comfortably positioned on seat 10, as shown in FIG. 2*e*, the sheet drive on front roller 5 is stopped and the mattress lift arms 17 are driven to raise the mattress 9.

Figure 2F:
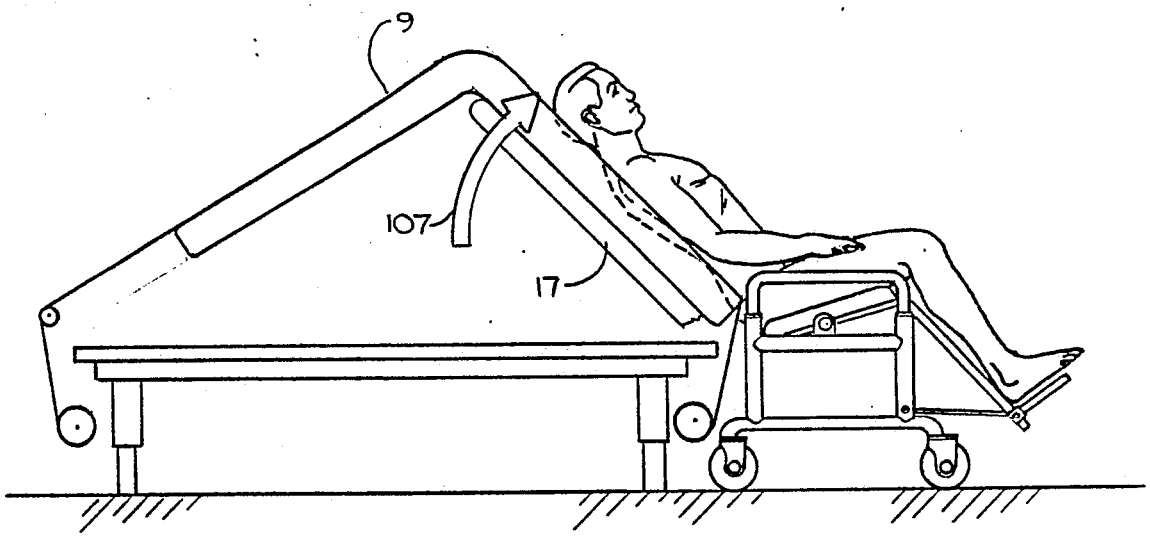

FIG. 2*f* shows the mattress 9 partially raised in accordance with arrow 107 by the lift arms 17.

Figure 2G:
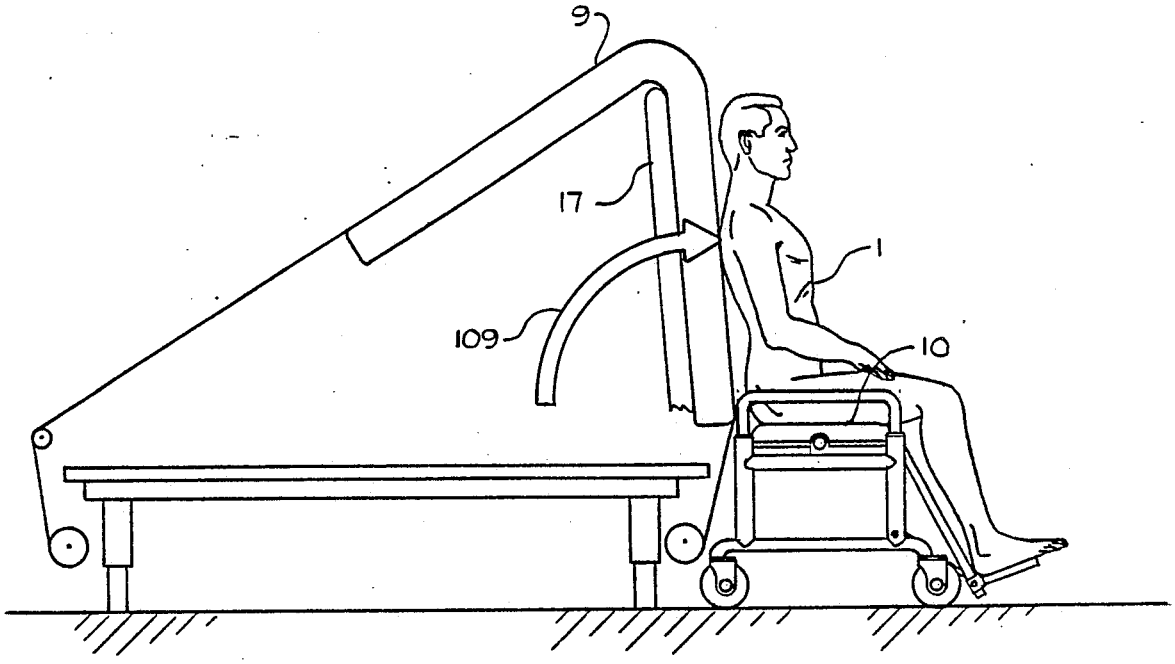

FIG. 2*g* shows the mattress 9 fully elevated and supporting the person 1 on seat 10. Seat 10 has been fully rotated to a normal horizontal seating position, where it automatically latches. This final rotation of seat 10 may be accomplished by the forward weight shift of person 1 as lift arms 17 move him forward in the direction of arrow 109. Alternatively, the seat rotation may be driven by means to be described subsequently.

Figure 2H:
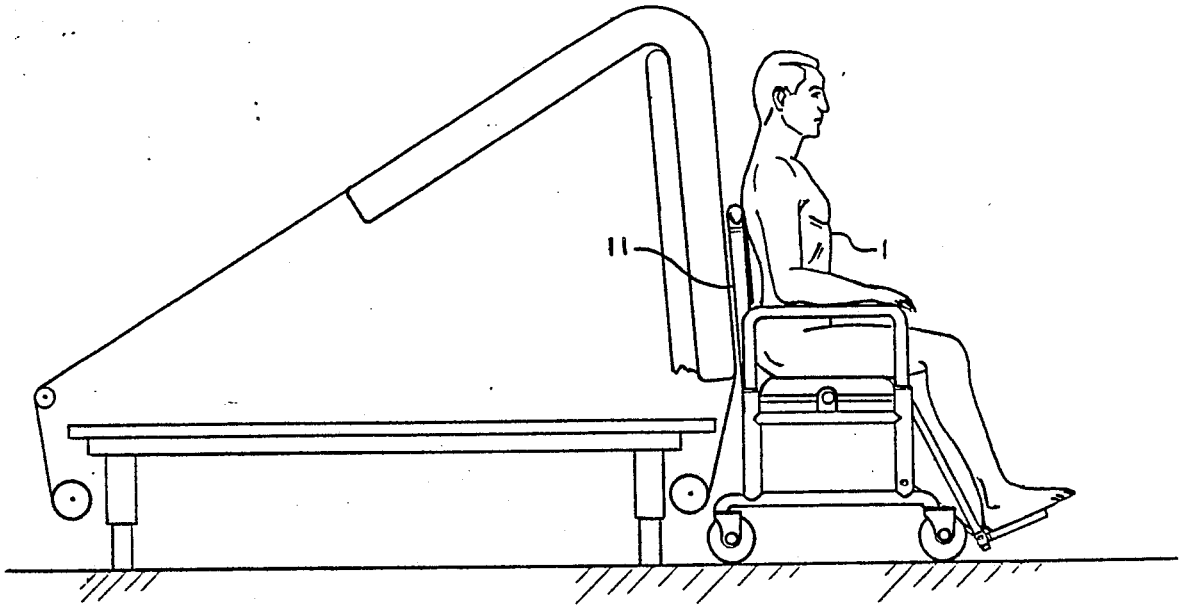
Figure 2I:
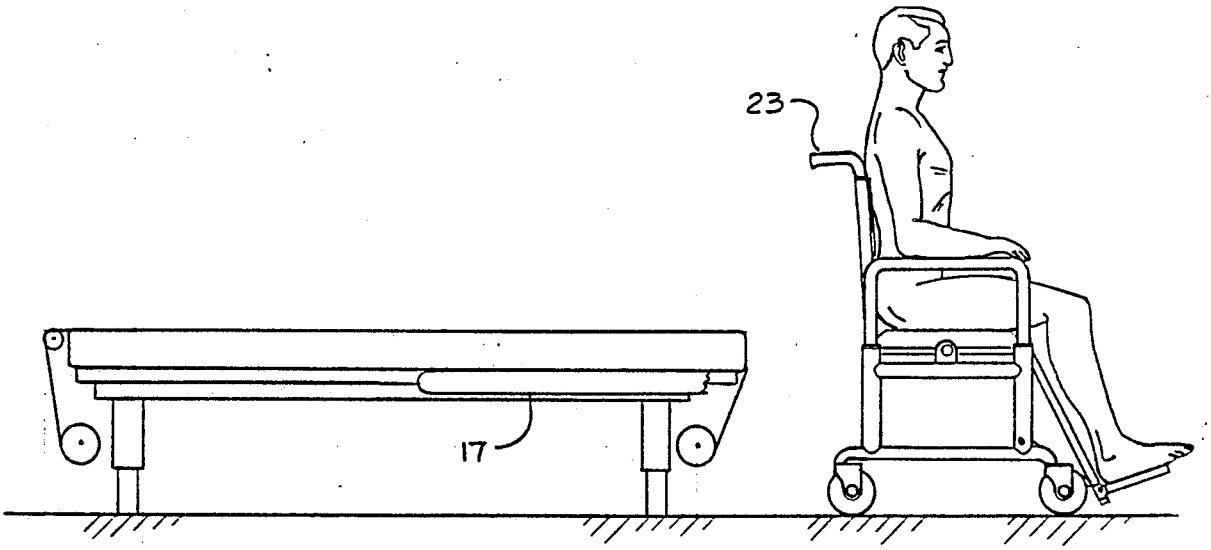

FIG. 2*h* shows that the back rest 11 has been manually (or automatically) replaced behind the person 1. The wheelchair is then unlatched and moved away from the bed, the hand grips 23 are rotated to their normal positions and the mattress lift arms 17 are lowered to complete the transfer operation, as shown in FIG. 2*i*.

Figure 3:
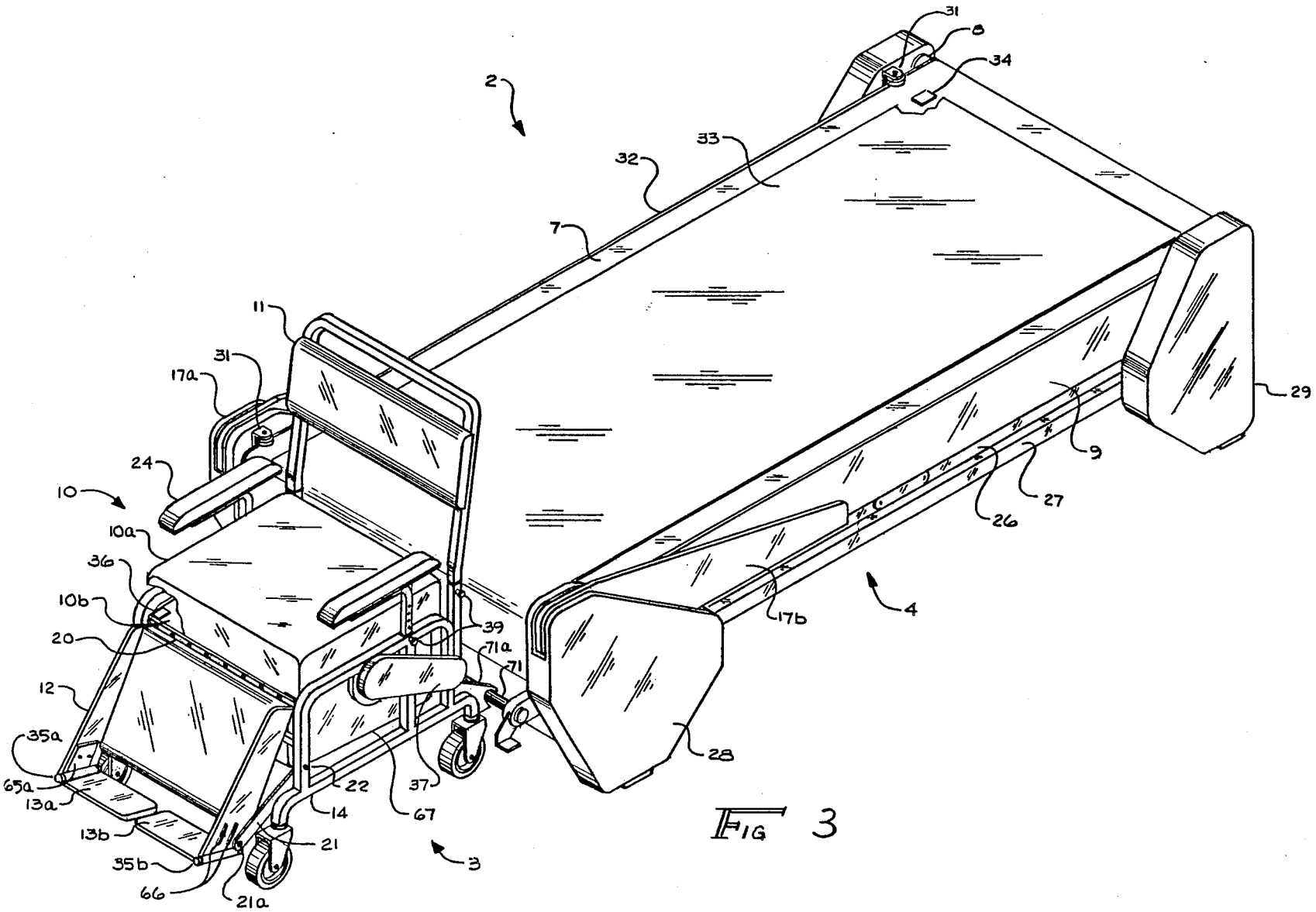
FIG. 3 is a perspective view of the invalid transfer arrangement showing the wheelchair latched to the bed.
Figure 5:
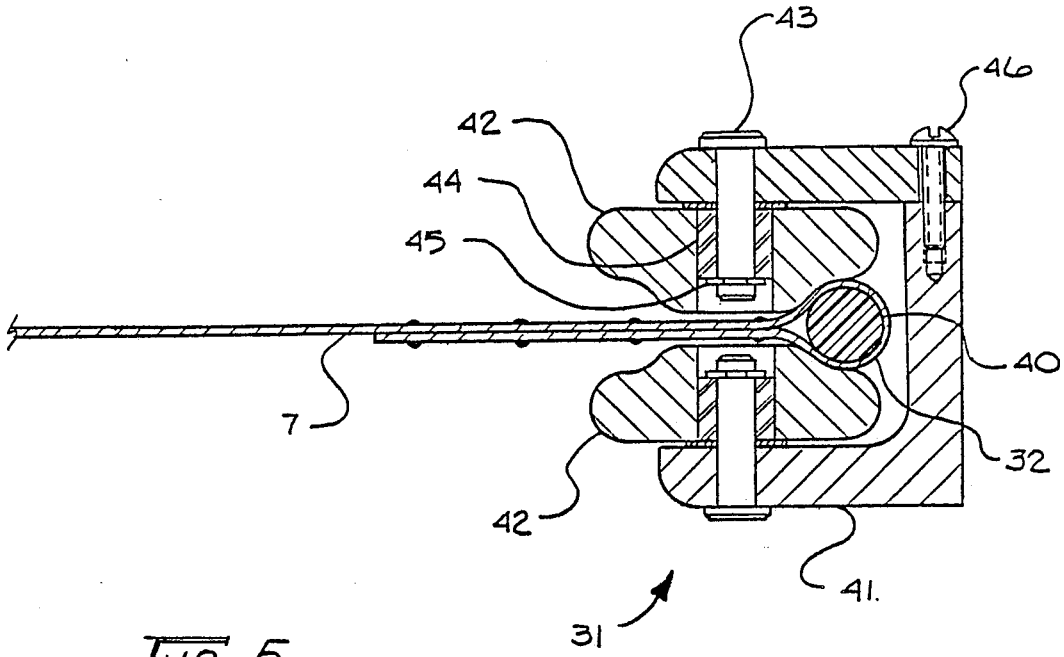
FIG. 5 is a partial end cross-sectional view through one edge of the transport sheet add one of the guide roller units.
Figure 6:
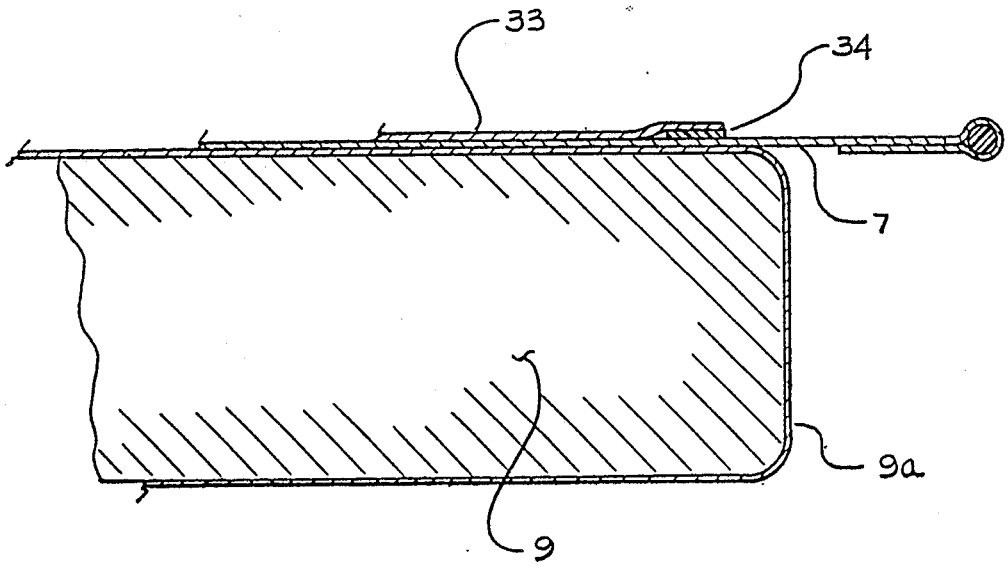
FIG. 6 is a partial end cross-sectional view of the mattress showing a bed sheet fastened onto the transport sheet.

FIG. 3 is a perspective view of the invalid transfer arrangement, showing wheelchair 3 latched to the bed. The bed 2 consists of a modified standard hospital-type bed 4, including an articulated frame 26, a support frame 27, and a mattress 9 which includes a slippery outer cover of nylon or similar material to provide low friction surface over which a transport sheet can slide. At the foot and head ends of the bed, front and rear drive units 28 and 29, respectively, ar mounted to the fixed frame 27. These units include front and rear rollers and their drives, which are described subsequently. The front drive unit also includes mattress lift arms 17*a* and 17*b* and their drive unit also described subsequently. A transport sheet 7 having a low-friction bottom surface for sliding over the mattress cover extends over the mattress 9 between front and rear rollers 5 and 6 (not shown here) in drive units 28 and 29. Idler roller 8, bolted or otherwise fastened to articulated frame 26 supports the transport sheet 7 at the head end of mattress 9. The front and rear drive units 28 and 29 include guide roller units 31 through which pass thickened hems 32 of the transport sheet 7, as shown in FIG. 5 and described subsequently. Guide rollers 31 keep transport sheet 7 taut across mattress 9 so that transport sheet 7 winds up in an orderly way on the rollers in front and rear drive units 28 and 29. A bed sheet 33, somewhat longer and narrower than the top of mattress 9, is fastened to transport sheet 7 by sheet fasteners 34 at each corner. As shown in FIG. 6 and described subsequently, these fasteners may consist of strips of press-and-hold, pull-and-release material such as that available commercially under the trade name VELCRO, or other attachment methods may be used, such as snaps, zippers, hooks and eyes, or the like. The fastener locations may also be different—for example extending along one or more edges of sheet 33. Several such bed sheets may be fastened in succession along the transport sheet 7 so that when bed 2 is unoccupied, a clean bed sheet can be moved onto mattress 9 by moving transport sheet 7.

The use of bed sheets attached to a transport sheet has the advantage that the bed and transport sheets can be made with different characteristics. For example, the transport sheet 7 can be made of a strong material such as dacron and may include a non-permeable coating or layer of material such as rubber. It may also include coatings or layers of material which provide the desired coefficients of friction on top and bottom surfaces. The bed sheets 33 can be of materials such as cotton, commonly used in bed sheets to maximize patient comfort. Non-permeable sheets also can be used. In addition to, or in place of, a bed sheet, a pad, such as an absorbent pad for incontinent patients, or a bedsore protection pad can be used. Alternatively, separate bed sheets 33 can be eliminated, and the transport sheet 7 can serve as a bed sheet. In this case transport sheet 7 may be fabricated in sections, fastened together by zippers or other fastening means, so that when a section is soiled, it can be replaced with a clean section.

FIG. 3 shows the wheelchair 3 locked to bed 2 through a chair latch 71*a* and toothed drive shaft 71, described subsequently. A seat pivot drive under cover 37 is also described subsequently. Back rest 11 can be removed and arm rests 24 can be adjusted or removed from frame 14 by pulling out holding pins 39 on each side of the wheelchair.

Right and left foot rests 13*a* and 13*b* are fastened to leg rest 12 by right and left hinges 35*a* and 35*b*, which enable the foot rests to fold up for convenience. Extension brackets 65*a* bolted to leg rest 12 through slots 66 enable the position of the foot rests to be adjusted so that an individual person will be transferred the proper distance onto seat 10, as already described previously. Leg rest 12 is connected to frame 14 by links 21 through pivots 21*a* and 22, and by hinge 20 to seat 10.

Seat 10 is comprised of seat cushion 10*a* removably fastened to seat base 10*b* by cushion fasteners 36 composed of press-and-hold, pull-and-release material such as that available commercially under the trademark VELCRO, or by other attachment methods such as snaps. Under seat 10 is chamber pot 67.

Figure 4:
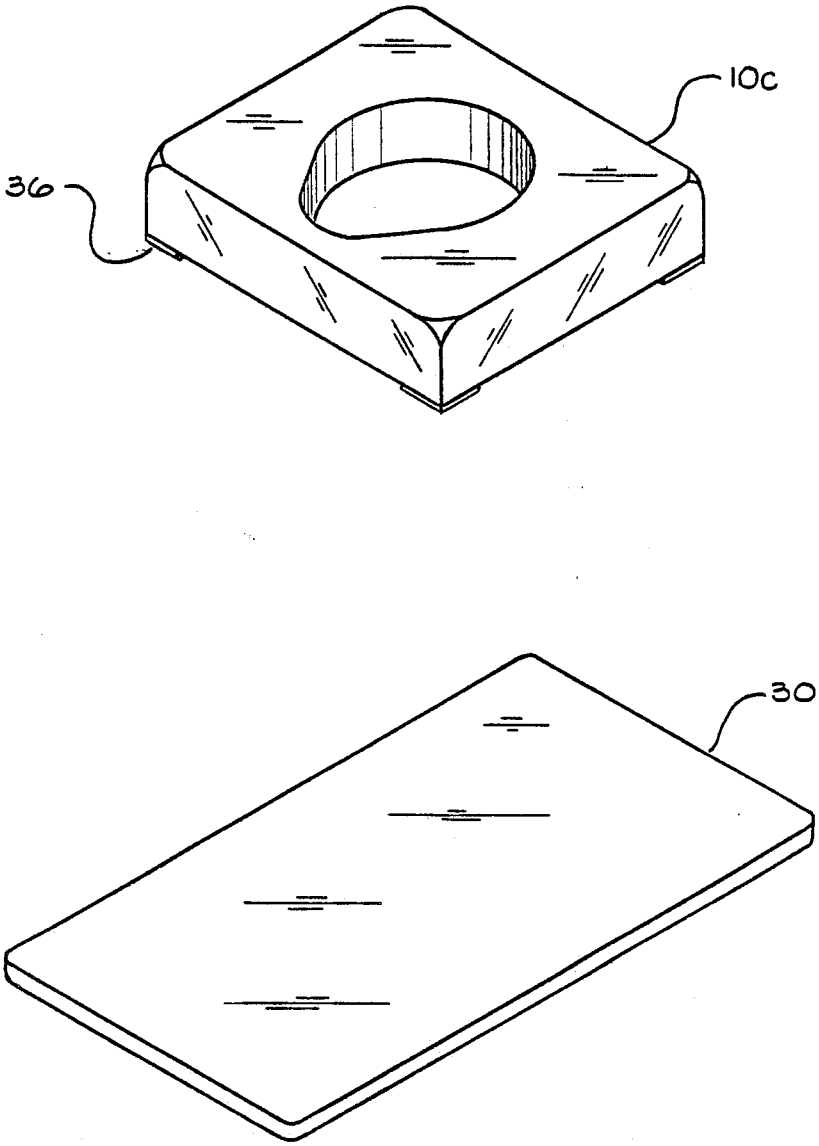
FIG. 4 is a perspective view of a commode seat which can be installed in the wheelchair and a pad for the bed.

FIG. 4 shows a perspective view of a commode seat 10*c* which is also equipped with cushion fasteners 36 and is readily interchangeable with seat cushion 10*a*, and a pad 30 which is attachable to sheet fastener 34 on transport sheet 7, shown in FIG. 3.

FIG. 5 is a partial end cross-sectional view through transport sheet 7 and one of the guide roller units 31. The guide roller unit 31 comprises a guide roller housing 41 held together by bolt 46. Two hem rollers 42 are each rotatably supported by a bearing 44 on a flanged roller pin 43 which passes through the guide roller housing 41 and is held in place by a retaining ring 45. FIG. 5 also shows transport sheet 7 with a thickened hem 32 formed by folding the edge of sheet 7 around a rope 40 and sewing or otherwise fastening together the overlapped portions of the sheet. The rope 40 may be of nylon or other strong flexible material. FIG. 5 shows that the two hem rollers 42 are positioned and shaped so that the overlapped sheet passes freely between them, but the thickened hem 32 is captured behind the hem rollers and passes freely behind and around them in such a way that the transport sheet 7 is firmly supported against forces pulling inward toward the center of the bed. Four such guide roller units 31, one near each corner of the bed 2, as illustrated in FIG. 3, prevent the transport sheet 7 from being pulled in toward the center of the mattress 9 so that it will wind up in an orderly fashion on the foot-end and head-end rollers 5 and 6, shown in FIG. 1*a*.

FIG. 6 shows a partial end cross-sectional view of the mattress 9, the transport sheet 7 and bed sheet 33 taken through one of the sheet fasteners 34. Mattress 9 includes a low-friction mattress cover 9*a* over which transport sheet 7 slides. The bed sheet 33 is removably fastened to transport sheet 7 by sheet fasteners 34.

Figure 7:
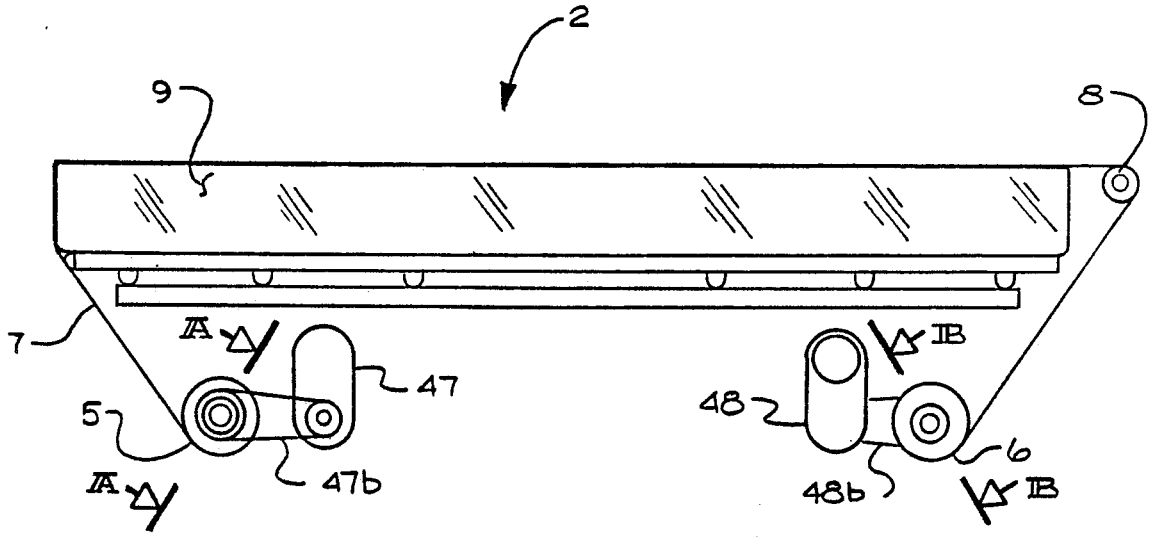
FIG. 7 is a partial side view of the bed showing schematically the arrangement of the transport sheet drives.

FIG. 7 is a schematic side view of the bed 2 showing the arrangement of the transport sheet drives already described previously. It shows the transport sheet 7 partially rolled up on front roller 5, driven by front sheet drive 47 through belt 47*b*. Transport sheet 7 extends over the length of mattress 9, over idler roller 8 and is partially wrapped around rear roller 6, driven by rear sheet drive 48 through belt 48*b*.

Figure 8:
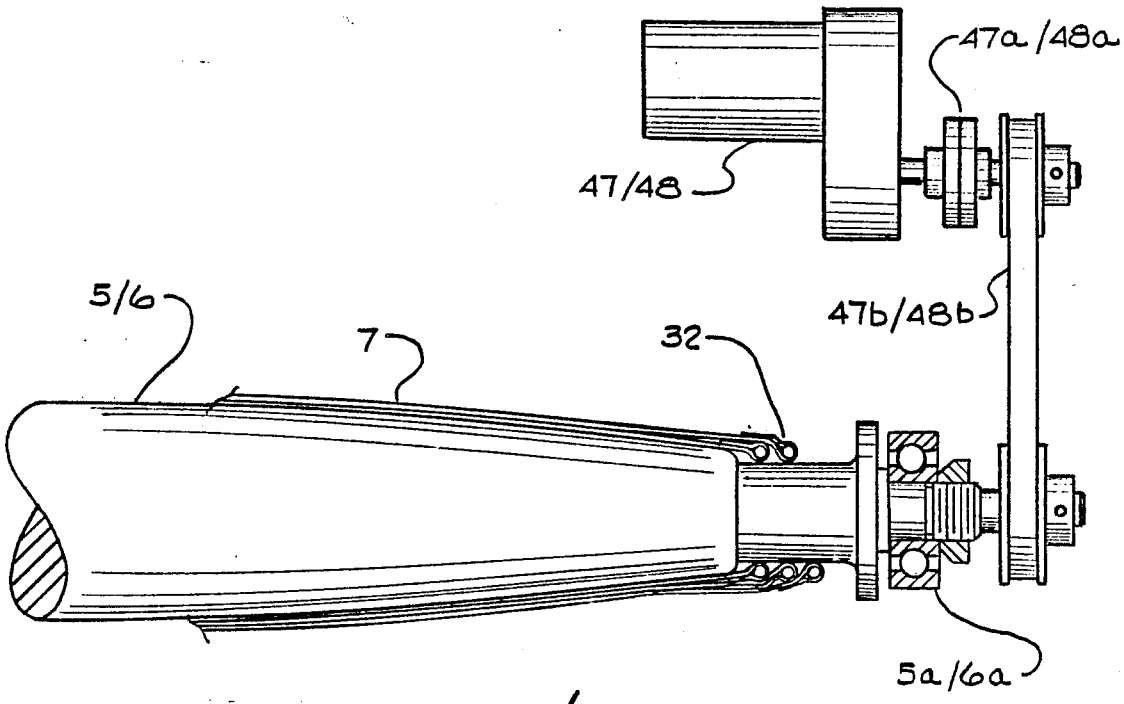
FIG. 8 is a partial elevated cross-sectional view showing the transport sheet drives and the shape of the rollers.

FIG. 8 is an elevated front end view, AA in FIG. 7, of the front roller 5 rotating on bearings 5*a* in the front drive unit 28 and driven by front sheet drive 47 through front clutch 47*a* and belt 47*b*. The elevated rear end view BB in FIG. 7 is identical. Front and rear sheet drives 47 and 48, respectively, comprise conventional reversible a-c motors driving through speed reduction gear boxes. Alternatively, variable speed a-c or d-c motor drives may be used, to accommodate special patient needs. Front and rear clutches 47*a* and 48*a* can be engaged or disengaged electrically. When either clutch is disengaged, the corresponding sheet roller is free to rotate and the transport sheet 7 can be freely drawn off that roller. When a clutch is engaged, the corresponding sheet roller can be motor driven and otherwise is held in place by residual friction.

The front and rear rollers 5 and 6 are thickest in the middle and taper down to a small diameter near both ends to cause the transport sheet 7 and the thickened hem 32 to wind up in an orderly fashion in the end regions of the rollers as shown in FIG. 8, and to concentrate the pulling force at the center of the transport sheet where the drag load of the is concentrated, thereby preventing the sheet from pulling in toward the center of the bed.

Figure 9:
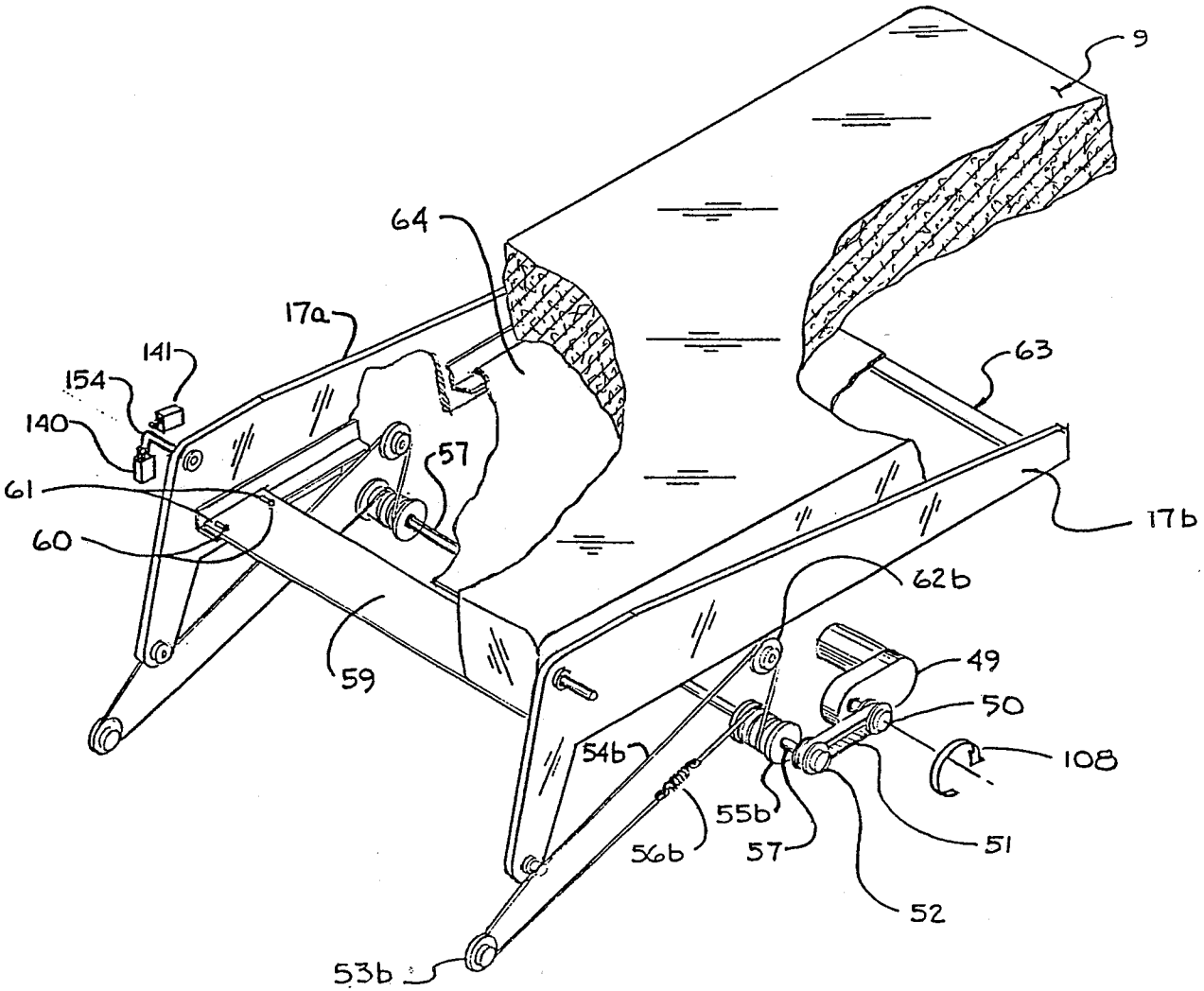
FIG. 9 is a partial perspective schematic view of the mattress and mattress lift drive components.

FIG. 9 shows a partial perspective schematic view of the mattress and the mattress lift drive components, which are part of the front drive unit 28.

Lift drive 49, comprising a reversible electric motor and gear box, is coupled to drive shaft 57 through sprocket 50, chain (or toothed belt) 51, and sprocket 52. Drive shaft 57 is rigidly connected to cable drum 55*b*. Cable 54*b* is wound several turns around, and fastened at one end to, cable drum 55*b*. The remainder of cable 54*b*, connected through spring 56*b*, extends around pulleys 53*b* and 62*b*, is clamped to lift arm 17*b* and is wound in the other direction around, and fastened to, cable drum 55*b*. When lift drive 49 drives sprocket 50 counterclockwise, as shown by arrow 108, cable 54*b* is pulled by cable drum 55*b* to raise left lift arm 17*b*. Right lift arm 17*a*, which is connected to drive shaft 57 by a right-hand set of equivalent drive components, is raised in conjunction with lift arm 17*b*. Cross brace 63, fastened to lift arms 17*a* and 17*b*, and extending underneath the mattress 9 raises the mattress. Upper and lower limit switches 141 and 140, driven by actuator 154 on lift arm 17*a*, act to control the lift drive 49.

Mattress support 59 extends between lift arms 17*a* and 17*b* and is mounted thereon. Support 59 supports the end portion and edges of the mattress 9 and prevents them from flexing longitudinally. Mattress support 59 comprised of a thin flexible material is loosely mounted by bolts 60 through slots 61. The middle of the support, but not its edges, is free to sag under the weight of a person. Cloth support 64 fastened to the lift arms 17*a* and 17*b* helps support the mattress when it is lifted.

Figure 10:
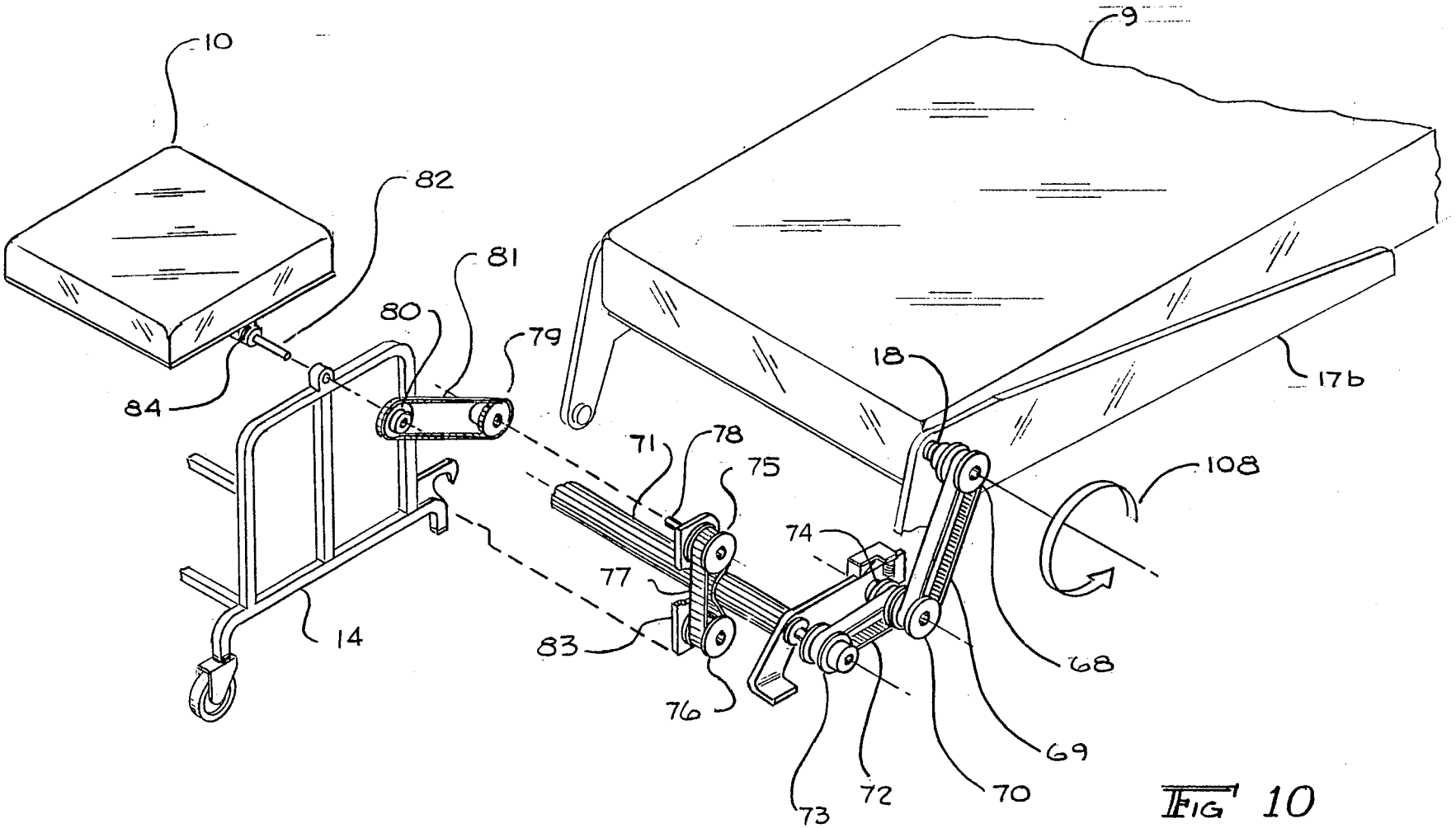
FIG. 10 is a partially exploded diagram showing the drive mechanism between the mattress lift arms to the wheelchair seat.

FIG. 10 shows an exploded view of a mechanism for mechanically coupling the mattress lift to the wheelchair seat. Sprocket 68, rigidly attached to lift arm 17*b* at pivot 18, drives sprocket 70 through chain 69. Sprocket 70 is rigidly attached to sprocket 74 which drives sprocket 73 through chain 72. Toothed shaft 71, rigidly attached to sprocket 73, is thereby coupled to lift arm 17*b* and rotates with it. Toothed shaft 71 engages a double-sided toothed belt 77 which passes around support sprockets 75 and 76, rotatably mounted on bracket 83 which is rigidly mounted on wheelchair frame 14. The latch which holds toothed shaft 71 against belt 77 is described subsequently.

Shaft 78 is rigidly attached to sprocket 75 and 79 which drives sprocket 80 through chain 81. Sprocket 80 is rigidly attached to shaft 82, which passes through and is rotatably supported by wheelchair frame 14. Shaft 82 is thereby coupled directly to and rotates with lift arm 17*b*, at approximately twice the angular speed (determined by the sprocket diameters). Shaft 82 drives seat 10 through coupling sleeve 84.

Figure 10A:
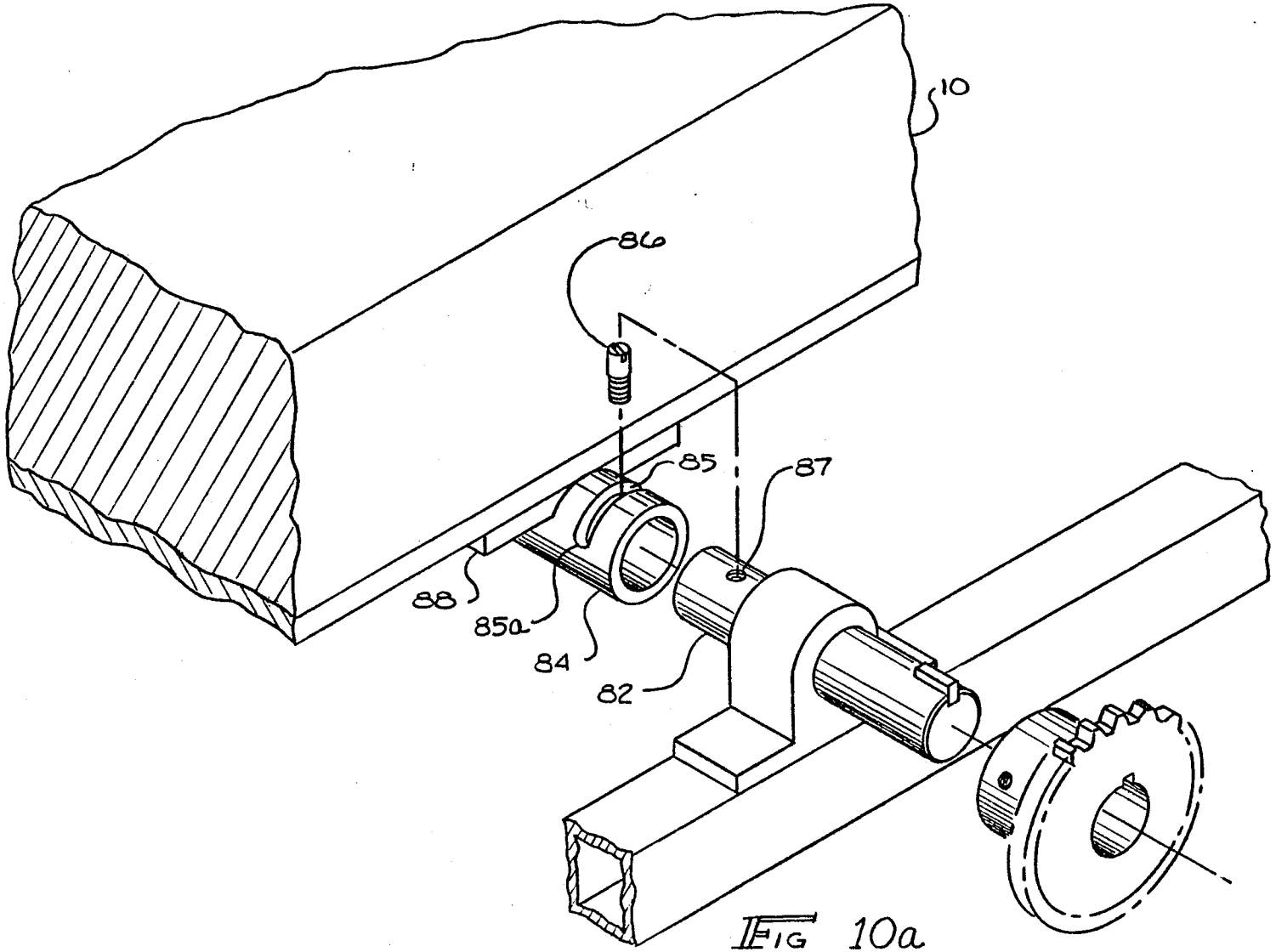
FIG. 10*a* is a partially exploded diagram showing the drive coupling to the wheelchair seat.

FIG. 10*a* shows, in perspective, the coupling between shaft 82 and seat 10. Shaft 82 fits into coupling sleeve 84, which is rigidly attached to seat 10 by bracket 88. Pin 86 passes through slot 85 in sleeve 84 and is screwed into threaded hole 87 in shaft 82.

When the lift arm 17*b* is fully lifted to approximately 85 degrees elevation, pin 86 is rotated to one end 85*a* of slot 85, with seat 10 in its horizontal position. When the lift arm is lowered to the horizontal, shaft 82 with pin 85 is rotated clockwise 180 degrees so that seat 10 is free to rotate fully, as shown in FIG. 1*g*. When the lift arm 17*b* is raised again to its vertical position, shaft 82 pushes pin 86 against the slot end 85*a* and drives seat 10 back to its horizontal position.

Figure 11:
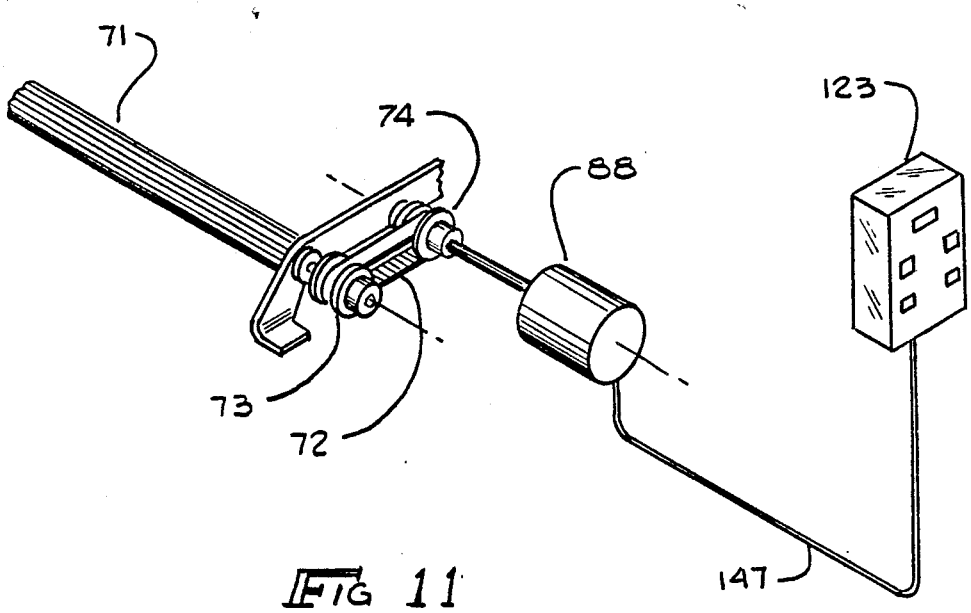
FIG. 11 is a partial perspective schematic showing an alternate drive for the wheelchair seat using an electric motor.

FIG. 11 shows schematically an alternate configuration with toothed shaft 71 coupled through sprockets 73 and 74 and belt 72 to a separate electric drive 88 rather than to lift arm 17*b*. Electric drive 88, is controlled in the same way as lift drive 49 by control circuitry in control unit 123, connected through cable 147.

Figure 12:
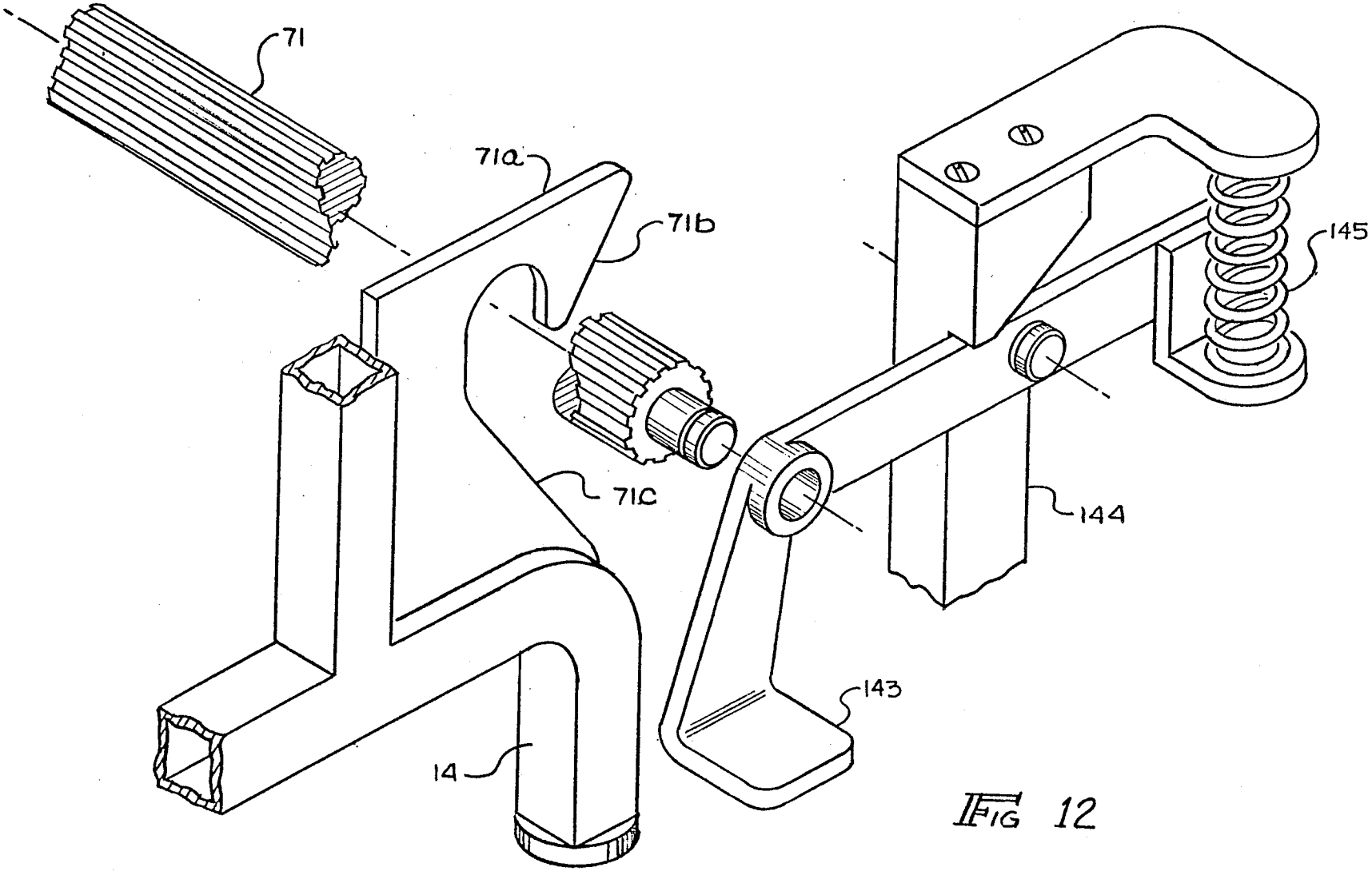
FIG. 12 is a partially exploded view of the mechanism for latching the wheelchair to the bed.

FIG. 12 show in perspective the mechanism for latching the wheelchair frame 14 to toothed shaft 71 on bed 2. Shaft 71 is rotatably supported by foot pedal 143 which is pivotably mounted on bracket 144, which is part of front drive unit 28. Spring 145 holds foot pedal 143 in its top position. A similar arrangement, not shown, supports the opposite end of shaft 71. Chair latch 71*a*, which is rigidly attached to wheelchair frame 14 at each side to avoid interference in moving over a toilet, is positioned over and retains shaft 71. The wheelchair is disengaged by stepping on foot pedal 143, which pivots down against spring 145 so that shaft 71, pushing against surface 71*c*, pushes the wheelchair away from the bed. Pushing the wheelchair toward the bed causes surface 71*b* to initially depress shaft 71 which is then pushed up by spring 145 into the latched position. With this arrangement, if a person is positioned toward one side of the bed, the wheelchair can be latched in a corresponding lateral position at the end of the bed.

Figure 13:
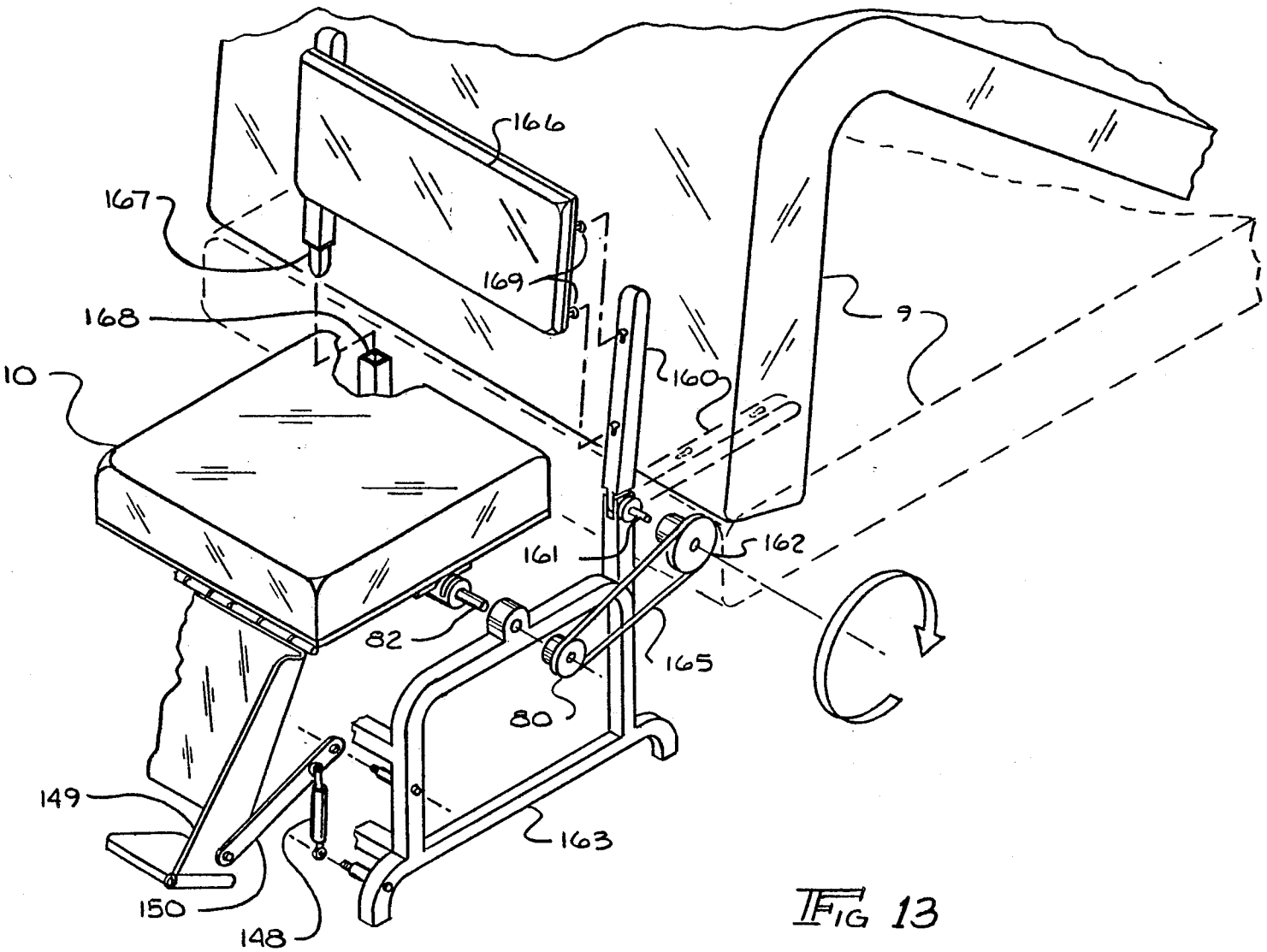
FIG. 13 is a partially exploded view of the wheelchair and bed showing a removable back rest and a mechanism for driving the wheelchair seat using a back rest support arm.

FIG. 13 shows in perspective an alternate method for driving the seat 10 in rotation whereby back rest support arm 160, rigidly attached to sprocket 162 by shaft 161, is pivoted to wheelchair frame 163. Sprocket 80 is driven through chain 165 by sprocket 162. Sprocket 80 connects to and drives seat pivot coupling shaft 82 to drive seat 10 as shown in FIG. 10*a*, already described previously. Arm 160 folds down on the mattress 9, as shown in dashed lines, and when mattress 9 is raised by lift arms 17, as shown in FIGS. 2*f* and 2*g*, seat 10 is driven to a horizontal position as arm 160 is raised to an upright position, where it locks in place by a latch as shown in FIG. 13*b*.

When arm 160 is released and lowered, compression spring 148 pushes up leg rest 149 through link 150, rotating seat 10 and the person thereon back toward the bed.

Back rest 166 is rigidly attached to arm 167 which is fitted into receptacle 168 in chair frame 163 after a person, not shown, has been raised to a sitting position on seat 10. Headed screws 169, or other suitable fasteners, engage in receptacles on arm 160.

Figure 13A:
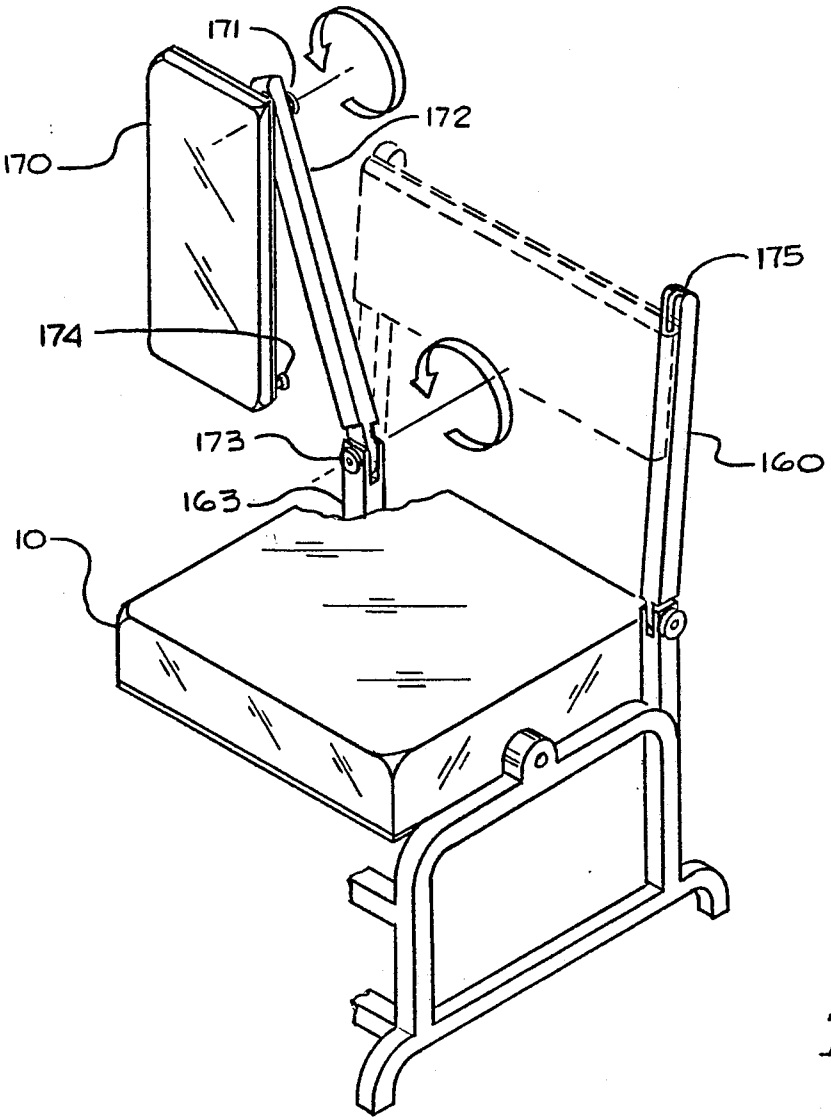
FIG. 13*a* is a partial perspective view showing a pivoted back rest and support arm.
Figure 13B:
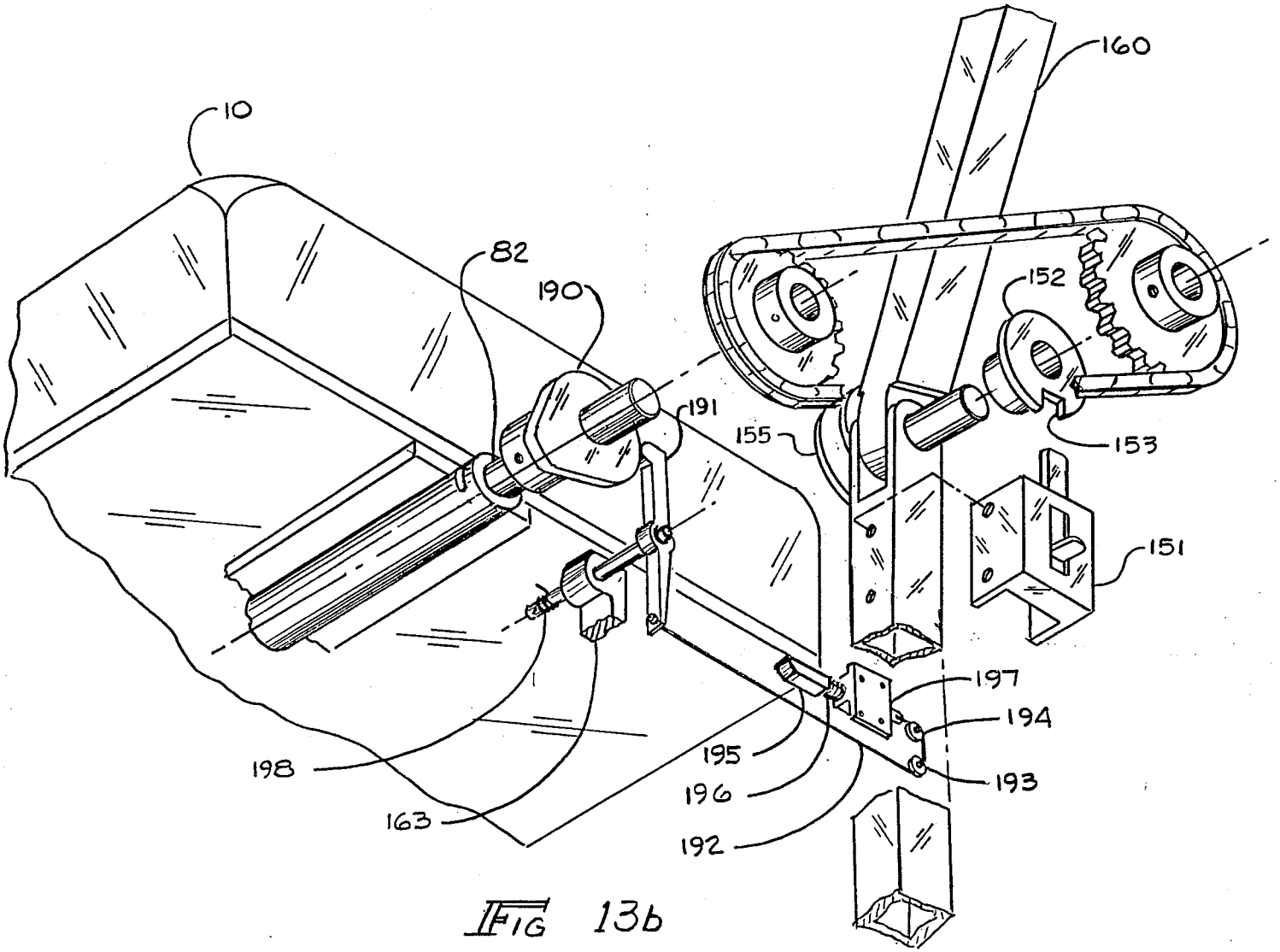
FIG. 13*b* is a partially exploded view showing a latching mechanism to limit rotation of the wheelchair seat until the back support arm is lowered.

FIG. 13*a* shows in perspective an alternate back rest arrangement in which back rest 170 is attached by pivot 171 to support arm 172, which is supported on pivot 173 mounted to wheelchair frame 163. Back 170 and arm 172 fold out to the side as shown while a person, not shown, is being transported off or onto the wheelchair seat 10. When the person is seated on seat 10, back rest 170 may be rotated around and attached to arm 160 by inserting tab 174 into receptacle 175 or by other means.

FIG. 13*b* is a perspective view looking up at the bottom of wheelchair seat 10 showing latching mechanisms. Transfer of person off the wheelchair is started by releasing latch 151, which otherwise locks arm 160 in an upright position and prevents seat 10 from rotating. A one-way latch 195 prevents seat 10 from rotating more than a predetermined angle, approximately 30 degrees from horizontal, until the latch is released. Latch 195 is released during transfer off the wheelchair when the mattress is lowered below an elevation angle of approximately 20 degrees. The purpose is to support the person being transferred and prevent him from being wedged between the wheelchair seat 10 and the mattress 9 until he has been lowered to a reclining position partially on the mattress 9, as shown in FIG. 1*e*.

FIG. 13*b* shows cam 190 fastened to shaft 82, which rotates in accordance with the elevation of arm 160 which rests on mattress 9, as shown in FIG. 13 and previously described. Shaft 82 can be driven equally well by lift arm 17*b* as shown in FIGS. 10 and 10*a* or by an electric drive as shown in FIG. 11. Actuator 191, rotatably mounted to fixed frame 163 and pushed against cam 190 by spring 198, is attached to latch 195 by cable 192 around pulleys 193 and 194. Latch 195 slides through latch housing 197, also mounted to frame 163, and is pushed out by spring 196 so that it stops the downward rotation of seat 10 whenever arm 160 is elevated above 20 degrees. Arm 160 is forced against the mattress by torsion spring 155. As the mattress is lowered, arm 160 drops below a predetermined elevation of approximately 20 degrees, and cam 190 moves actuator 191, pulling latch 195 against spring 196 and releasing seat 10 to rotate freely. When arm 160 is raised above 20 degrees elevation, latch 195 is pushed back in position by spring 196. Seat 10 is still free to rotate toward a horizontal position, pushing the slanted surface on latch 195 to move it out of the way. When arm 160 is raised to an upright position, spring-loaded latch 151 engages slot 153 in disc 152 fastened to arm 160, and latches arm 160 in position.

Figure 14:
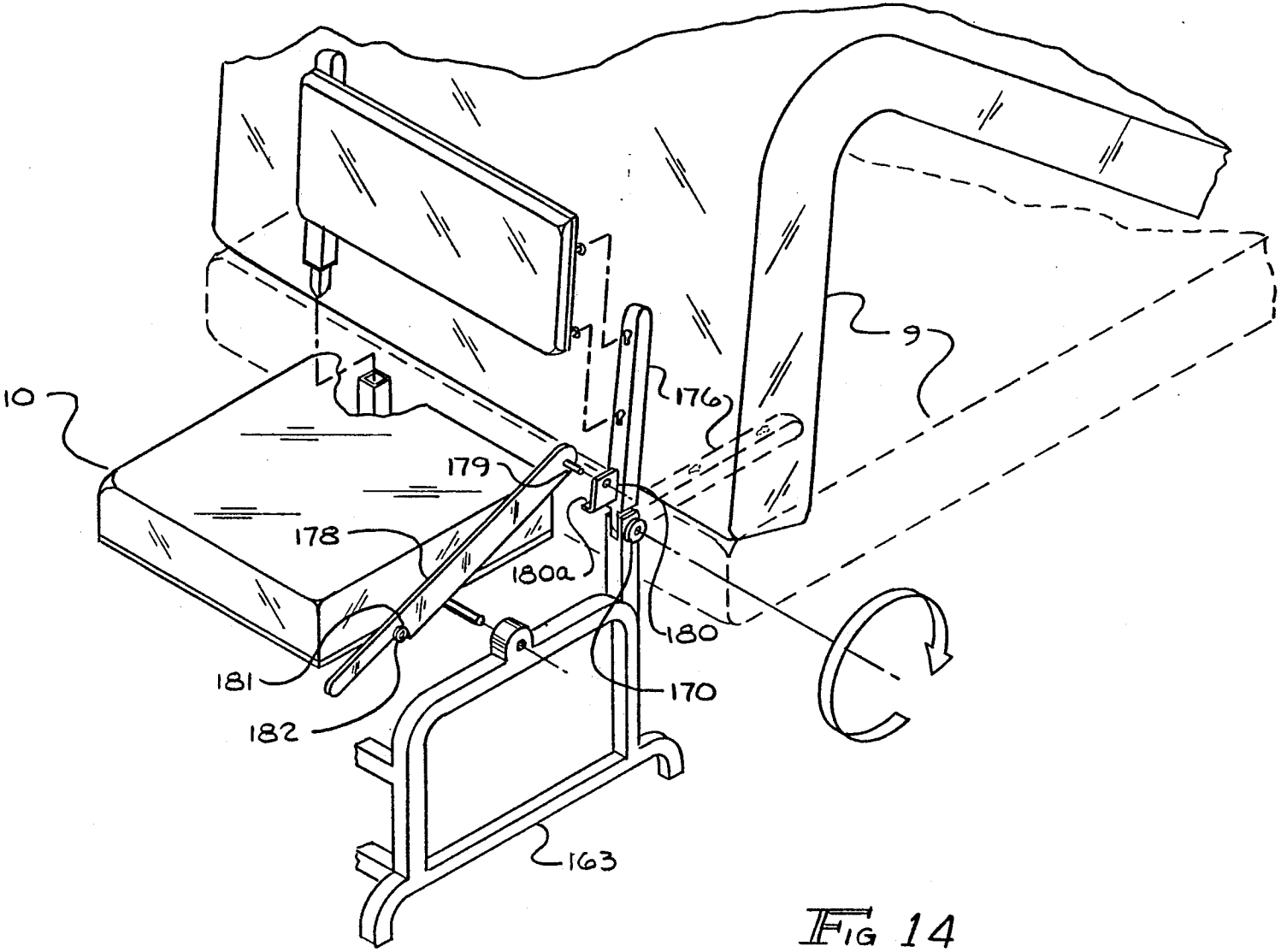
FIG. 14 is a partially exploded view of the wheelchair and mattress showing linkage mechanism for driving the wheelchair seat.

FIG. 14 shows in perspective a different method of driving seat 10, by mattress 9 acting on arm 176 which pivots back on the mattress 9 through pivot 170 mounted on wheelchair frame 163. The positions of arm 176 and mattress 9 when lowered are shown in dashed lines. Link 178 is attached to arm 176 by pivot 179 in bracket 180. Notch 181 on link 178 mates with pin 182 on seat 10 so that when arm 176 is erect, seat 10 is held in a horizontal position by link 178. When arm 176 is lowered, as mattress 9 is lowered by lift arms 17 as shown in FIGS. 1*c* through 1*e*, link 178 moves back from pin 182 and allows seat 10 to rotate proportionately. When arm 176 reaches an elevation of about 20 degrees, link 178 comes to rest on edge 180*a* of bracket 180, so that as arm 176 continues to rotate, link 178 is raised out of the path of pin 182. Seat 10 can then rotate freely, as the person is transported off seat 10 by the transport sheet. In transporting the person onto the wheelchair, the seat 10 rotates, as shown by arrow 106 in FIGS. 2*d* and 2*e*, to an elevation angle between 0 and 90 degrees. The mattress is then raised, raising thereby arm 176, which pushes link 178 forward and down. Link 178 then engages pin 182 as before and, pushing pin 82, drives seat 10 to a horizontal position as the mattress 9 and arm 176 approach a vertical position.

Figure 15:
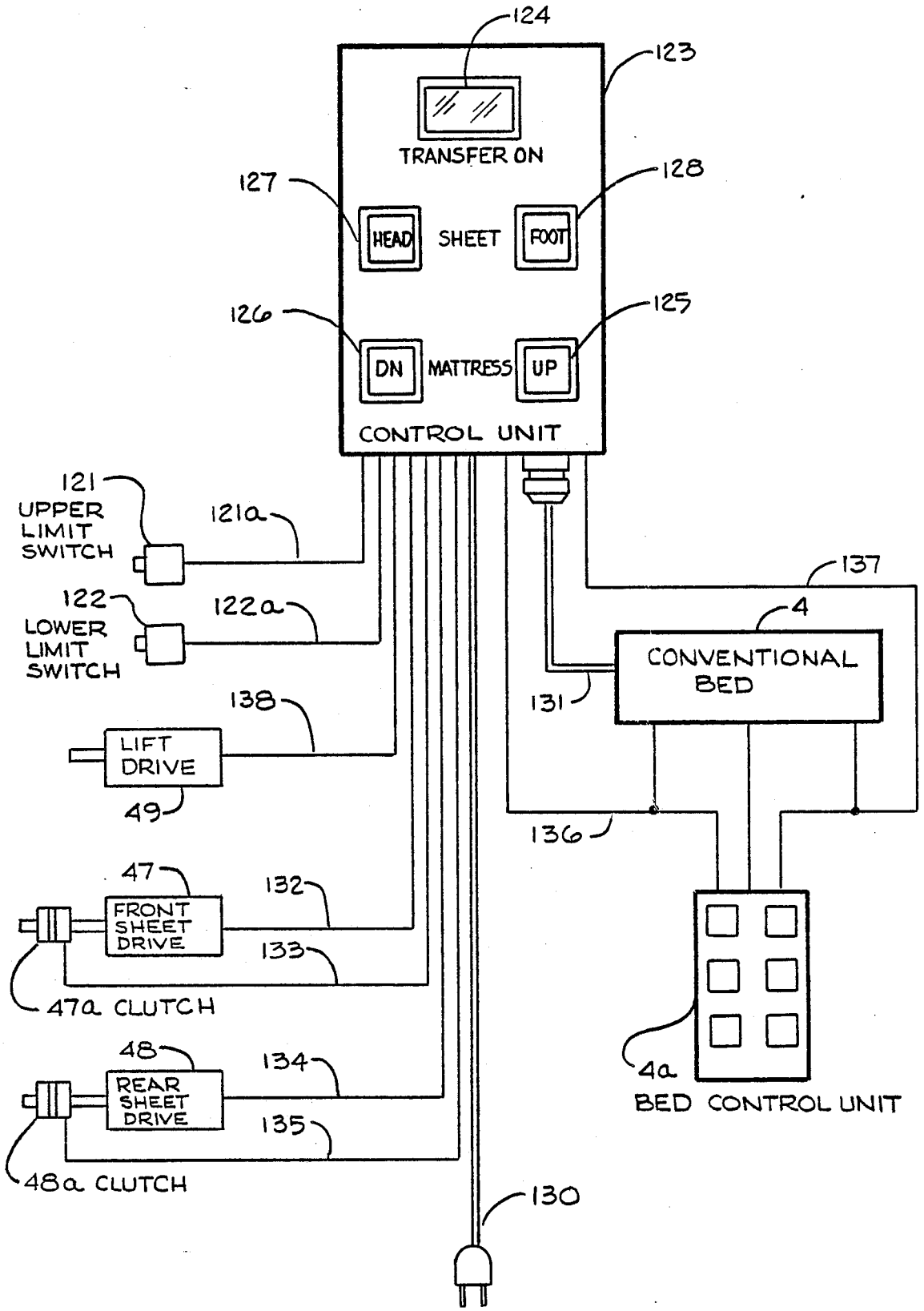
FIG. 15 is a schematic drawing showing a control unit connected to components of transfer equipment.

FIG. 15 schematically shows a manual control unit 123 and the system electrical cabling for operating the person transfer equipment, as shown in FIGS. 1*a* to 1*h* and 2*a* and 2*i*. The conventional bed control box 4*a* is used first to put the conventional bed in a horizontal position with the height adjusted so that the toothed shaft 71 shown in FIG. 3 matches the height of the mating latch on the wheelchair. Pushing switch button 124 on control unit 123 switches off the conventional bed controls.

Pushing switch button 128 or 127 actuates the front or rear sheet drives 47 or 48 and clutch 47*a* or 48*a* to move the transport sheet toward the foot or head of the bed, respectively. By using these buttons, the transport sheet is first moved to the proper position so that when a person is transferred he will be properly positioned on a bed sheet attached on the transport sheet, already described previously. The proper position is reached by aligning marks on the transport sheet or bed sheet with fixed points on the mattress or other fixed structure, such as the front drive assembly. This alignment can be determined visually by the operator, or by an optical, magnetic, physical displacement or other type of sensing mechanism. When the sheet is aligned, pushing switch button 125 activates the lift arm drive 49 in FIG. 9, to drive up the mattress as shown in FIG. 1*b*, until the power is switched off by upper limit switch 121. The wheelchair 3 can then be latched to bed 2, the back rest removed, and the arm rests lowered as shown in FIG. 3.

Depressing switch button 126 then lowers the mattress as shown in FIG. 1*e*, with the power being switched off by lower limit switch 122. As the mattress is lowered, switch button 127 is momentarily depressed to activate rear sheet drive 48 to take up the slack in the sheet as the mattress is lowered. Alternatively, this control action may be provided by an automatic programmer. After the mattress is horizontal, depressing switch button 127 activates the sheet drive 48 to move the person toward the middle of the bed. The button is released when he reaches the desired position on the bed, as shown in FIG. 1*h*.

Transferring a person 1 back to wheelchair 3 as shown in FIGS. 2*b* through 2*e* is done in a similar manner. Depressing switch button 128 activates the front sheet drive 47 and carries the person 1 onto the wheelchair 3 as shown in FIG. 2*e*. The button 128 is released when reclining person 1 is comfortably positioned on the wheelchair seat 10, as indicated by the elevation angle of seat 10. Alternatively, a sensor (not shown) can be used to measure the seat elevation and switch off the sheet drive at the selected elevation angle. Depressing switch button 125 then raises mattress 9 to its upper limit. The back rest can then be inserted, the arm rests raised, and the wheelchair unlatched to complete the transfer, as shown in FIG. 2*h* and 2*i*.

When a person has been transferred onto the bed the switch button 124 can be pushed again to re-activate the normal bed controls.

Circuits are included in the control unit 123 to disengage the clutches 47*a* and 48*a* as required in the sheet drive units, 47 and 48, so that the transport sheet can be drawn freely from the rollers when the foot or head sections of the bed are raised.

FIG. 15 also shows the interconnecting cables for controlling the transfer equipment. Input power enters the control unit 123 through cable 130, and while cable 131 supplies power from the control unit to the conventional bed. Cables 136 and 137 provide input control signals to the control unit 123 when the foot or head sections of the bed respectively are being raised or lowered. The front and rear drive units 47 and 48 and front and rear clutches 47*a* and 47*a* are connected through cables 132, 134, 133 and 135, respectively, to the control unit 123. Power to the mattress lift drive is supplied through cable 138. Upper and lower limit switches 121 and 122 are connected through cables 121*a* and 122*a*, respectively. Power to the lift and sheet drives and clutches and to the conventional bed is controlled in the control unit by switches and logic circuits well known to those skilled in the art to provide the operations described previously.

The control systems described above is largely manually controlled. However there is no intent to so limit the transfer arrangement, and an automatic control system can equally well be used. Such a system can easily be implemented by one skilled in the art by addition of sheet position sensors, timing sequences, and logic circuitry.

FIGS. 16*a* through 16*d* show sequentially the operation with an alternate arrangement of the wheelchair seat shown in FIG. 1*a*.

Figure 16A:
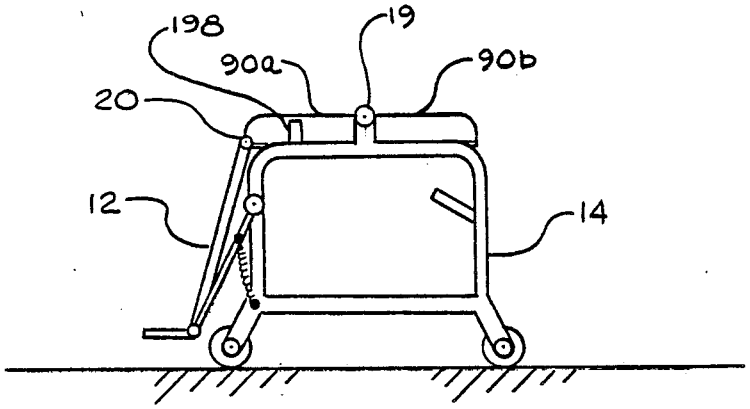
FIGS. 16*a* through 16*d* are schematic drawings showing sequentially the, operations of an alternate arrangement of the wheelchair seat.

In FIG. 16*a*, wheelchair seat 10 in FIG. 1*a* through 1*h* is replaced by a split seat comprising a rotating member 90*a* optionally attached to a folding member 90*b* by a cloth hinge, each member being pivoted to wheelchair frame 14 by pivot 19. Rotating member 90*a* is pivoted to wheelchair frame 14 and to leg rest 12 by pivots 19 and 20, respectively, in the same fashion as shown in FIG. 1*a* for seat 10, and the transfer operation is the same as shown in FIG. 1*a* through 1*h* except for the motion of folding member 90*b*. Folding member 90*b* is pivoted at its top edge by pivot 19 and is free to rotate counterclockwise, but not clockwise with respect to member 90*a*. Rotating member 90*a* is locked in position by latch 198. Latch 98 is now released.

Figure 16B:
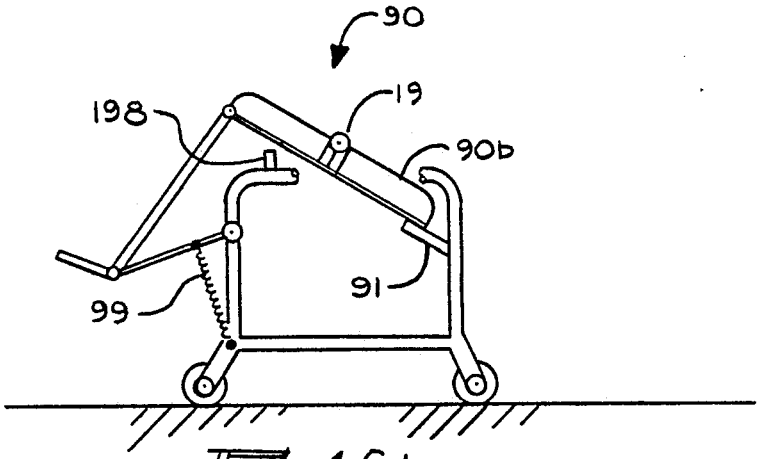

FIG. 16*b*, corresponding to FIG. 1*d*, shows seat 90 rotated approximately 30 degrees about pivot 19, pushed up by spring 99. At this point, folding member 90*b* reaches stop 91.

Figure 16C:
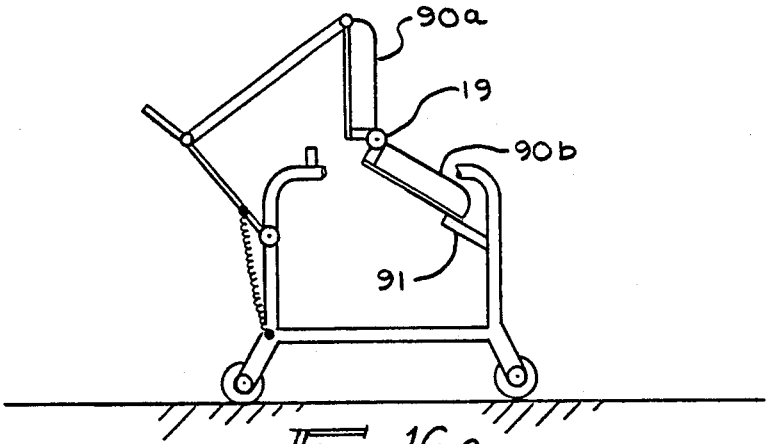

FIG. 16*c*, corresponding to FIG. 1*f*, shows further rotation of rotating member 90*a*, with folding member 90*b* supported by stop 91 and pivot 19 in such a position, that member 90*b* can support a person who might otherwise become wedged between the wheelchair seat 90 and the bed mattress 9.

Figure 16D:
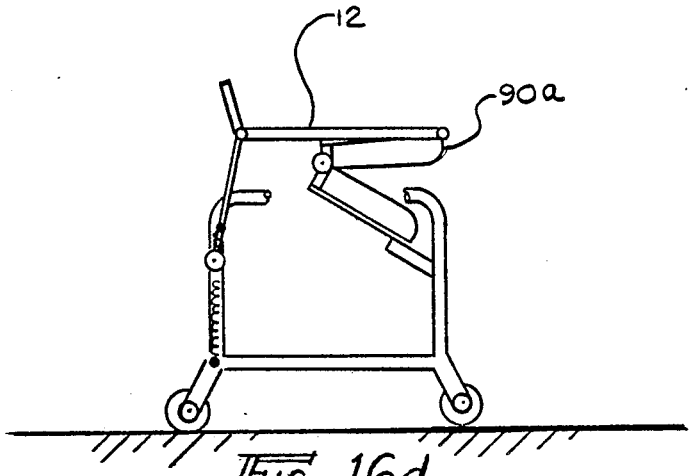

FIG. 16*d* shows the full rotation of seat member 90*a* with leg rest 12 in position to enable a person to be completely pulled off or be loaded onto the wheelchair by the bed transport sheet as shown in FIGS. 1*g*, 1*h*, 3*b* and 2*c*.

Figure 17A:
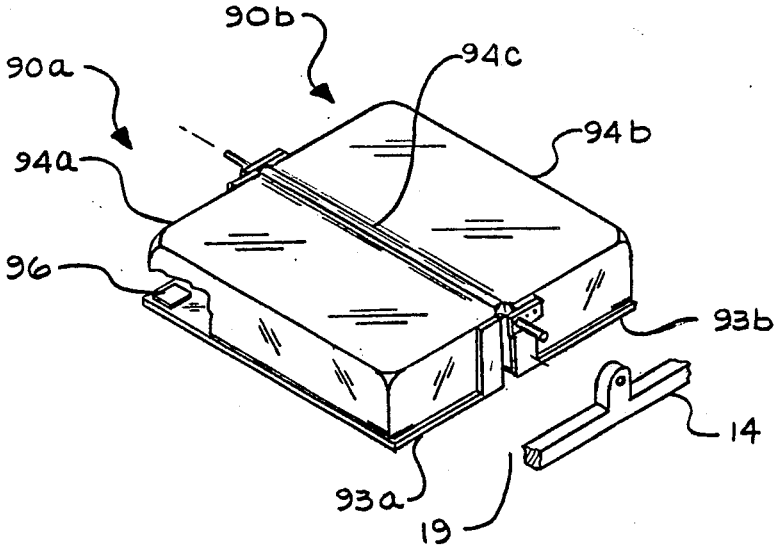
FIG. 17*a* is a partial perspective drawing showing a seat cushion installed for the alternate arrangement.
Figure 17B:
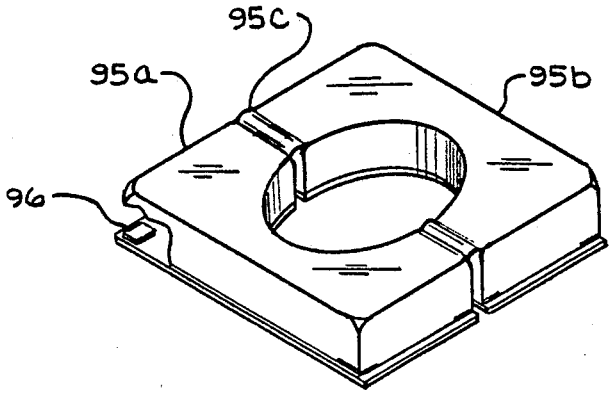
FIG. 17*b* is similar to FIG. 16*e*, except showing a toilet seat.

FIG. 17*a* schematically shows seat members 90*a* and 90*b* consisting of pivoted seat frame members 93*a* and 93*b*, respectively, pivoted on pivot 19 from frame 14, and supporting cushion members 94*a* and 94*b*, respectively, which are connected by optional cloth hinge 94*c* and are attached to the seat frame members by push-and-hold, pull-and-release material 96 such as that available under the trade name VELCRO. Cushion sections 94*a* and 94*b* are replaceable by toilet seat sections 95*a* and 95*b*, optionally connected by cloth hinge 95*c*, as shown schematically in FIG. 17*b* and held by the same push-and-hold, pull-and-release material 96.

Figure 18A:
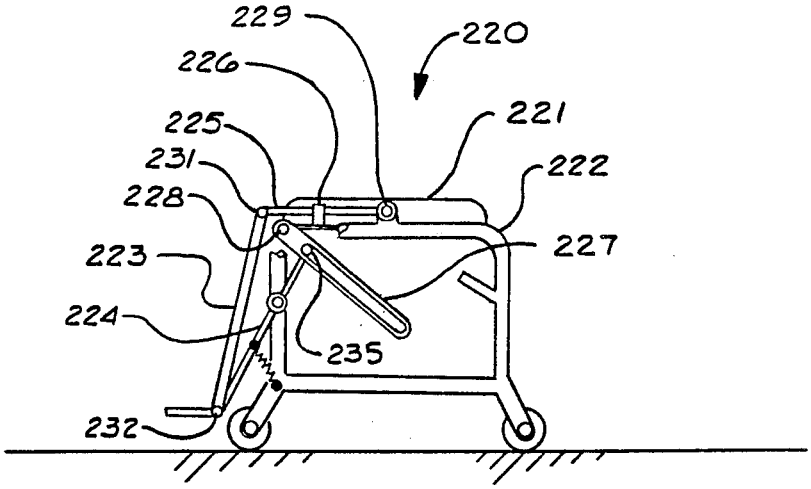
FIGS. 18*a* through 18*c* are schematic drawings showing sequentially the operation with another alternate arrangement of the wheelchair seat.
Figure 18B:
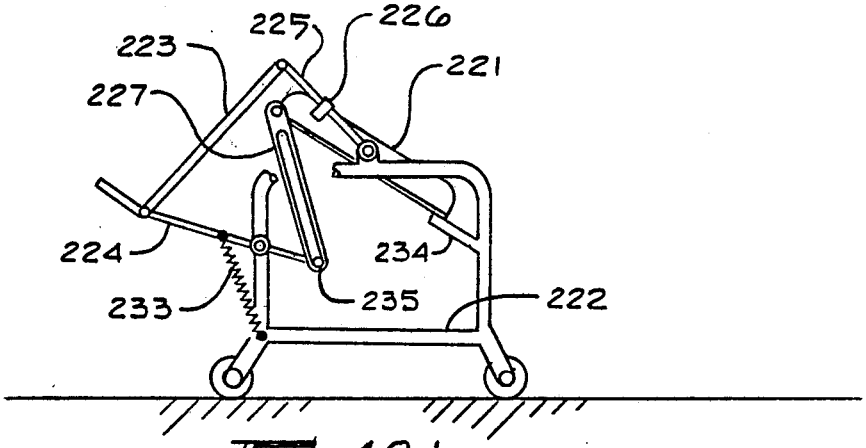
Figure 18C:
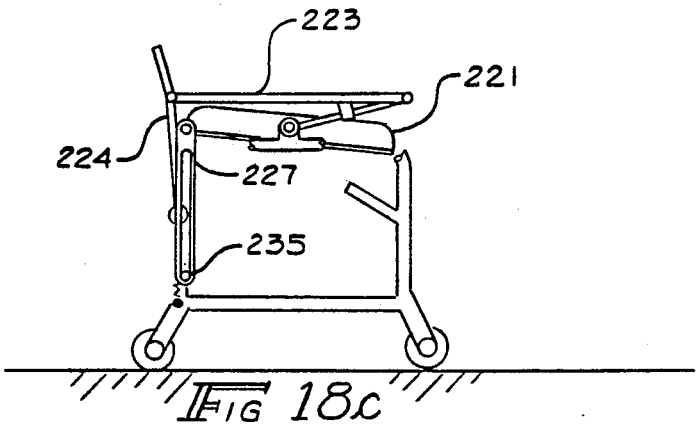

FIGS. 18*a* through 18*c* are partial schematics showing a further arrangement of the seat and leg rest transfer mechanism in a sequence of three positions.

FIG. 18*a*, corresponding to FIG. 1*c*, shows seat 221 movably mounted to pivots 229 on each side of frame 222 of wheelchair 220. Leg rest 223 is separately connected on each side to frame 222 through leg rest pivots 231 and 232, links 224 and 225, and frame pivots 228 and 229. Slotted link 227 is pivoted to seat 221 and rests on pin 235 attached to link 224. Seat latch 226 holds seat 221 and leg rest 223 in a normal seating position.

In FIG. 18*b*, corresponding to FIG. 1*d*, latch 226 mounted to link 225 releases seat 221, and spring 233 partially pushes up leg rest 223 from frame 222 through link 224. Seat 221 freely rotates against stop 234 which prevents further seat rotation. Slotted link 227 moves up with seat 221, sliding over pin 235 to the end of its slot.

FIG. 18*c*, corresponding to FIGS. 1*g* and 1*h*, shows the leg rest 223 in its final transfer position. The motion of link 224 lowers pin 235, pulling down slotted link 227 and returning seat 221 to a near-horizontal position under leg rest 223.

Figure 19:
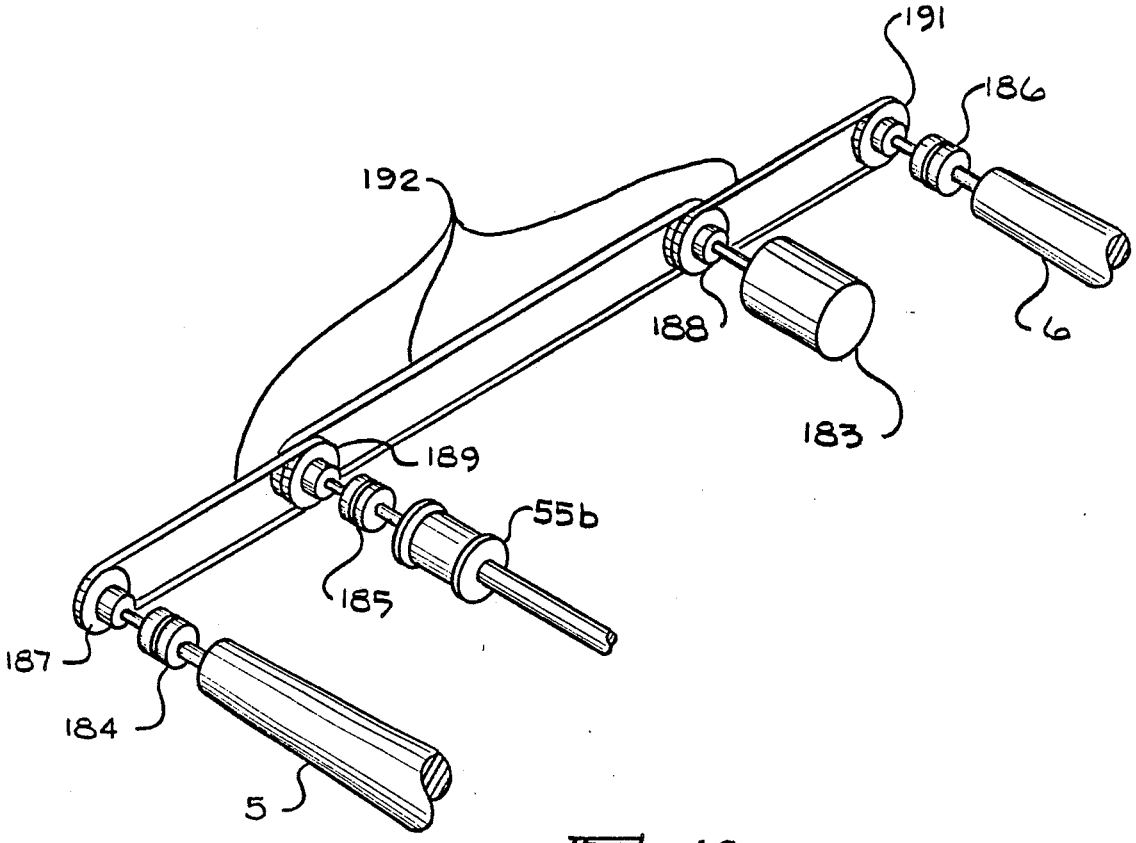
FIG. 19 is a partial perspective schematic view showing an alternative drive system for the sheet and mattress using a single motor.

FIG. 19 shows schematically another method of driving the sheet drive rollers and the mattress lift mechanism, in which a central reversible motor and gear box 183 is coupled through sprocket 188 and drive chains 192 through sprockets 187, 189, and 191 and clutches 184, 185, and 186 to front roller 5, rear roller 6 and lift cable drum 55*b*, respectively. Alternatively, other mechanical configurations can be used with shafts instead of chains to couple the motor and gear box 183 to the rollers and lift cable drum.

Figure 20A:
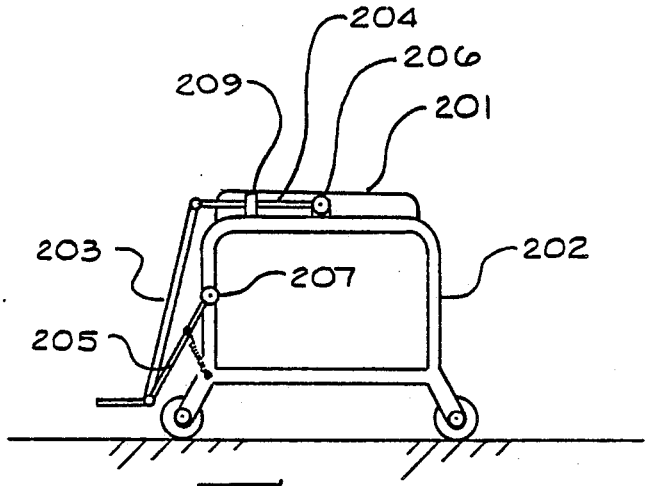
FIGS. 20*a* through 20*c* are sequential schematic drawings showing the operation of a wheelchair with a moving leg rest in conjunction with a fixed seat.
Figure 20B:
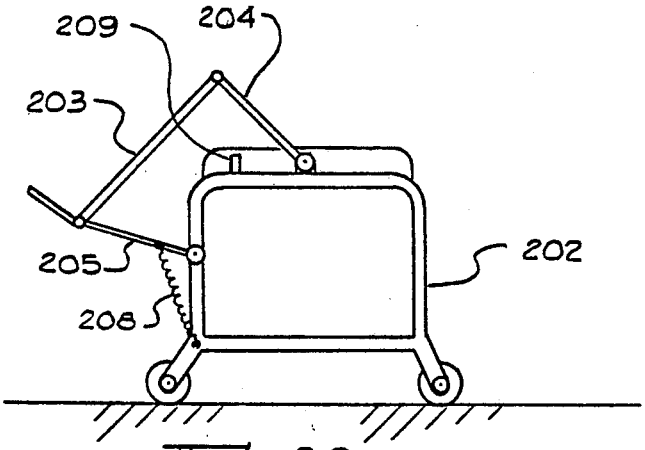
Figure 20C:
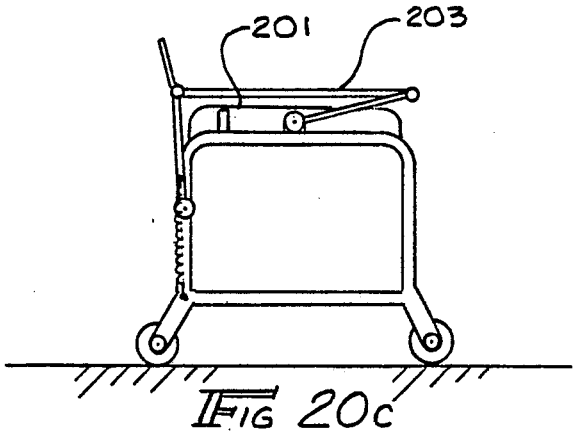

FIGS. 20 through 20*c* show schematically another alternate configuration of the wheelchair used in the transfer arrangement. FIG. 20*a* shows seat 201 rigidly attached to frame 202, and leg rest 203 connected on each side by links 204 and 205 through pivots 206 and 207 to frame 202 in a 4-bar linkage which provides the same leg rest motion as shown in FIGS. 1*a* through 1*h*. Leg rest 203 is held in position by latch 209 acting on link 204.

FIG. 20*b* shows leg rest 203 and link 204 pushed up by compression spring 208 acting on link 205, after latch 209 has been released.

FIG. 20*c* shows leg rest 203 in its transport position, over seat 201.

The transfer operation with the configuration, shown above, is the same as shown in FIGS. 1*a* through 1*b*, except that the person slides over seat 201 as he is raised to a seated position by mattress 9. Link 204 can be driven by the action of lifting the mattress, in the same way that seat 10 is driven, as shown in FIGS. 10, 10*a*, 11, 13, and 14.

Figure 21A:
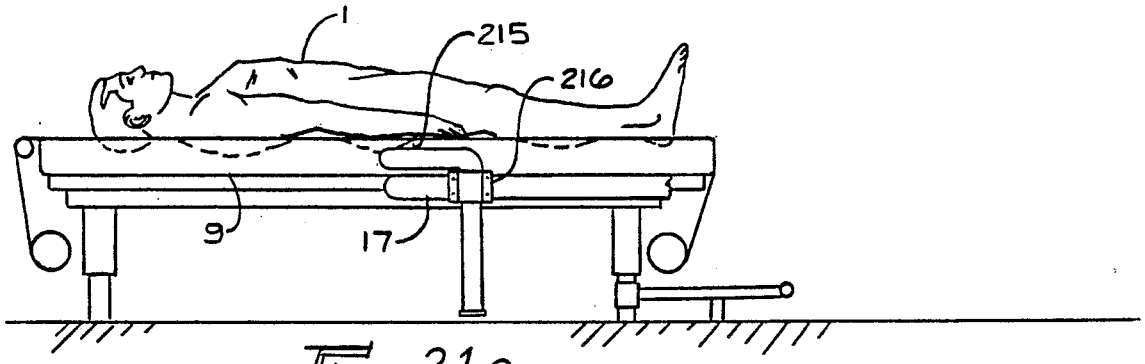
FIG. 21*c* through 21*c* are sequential schematic drawings showing an arrangement for moving a person from a bed to a standing position.
Figure 21B:
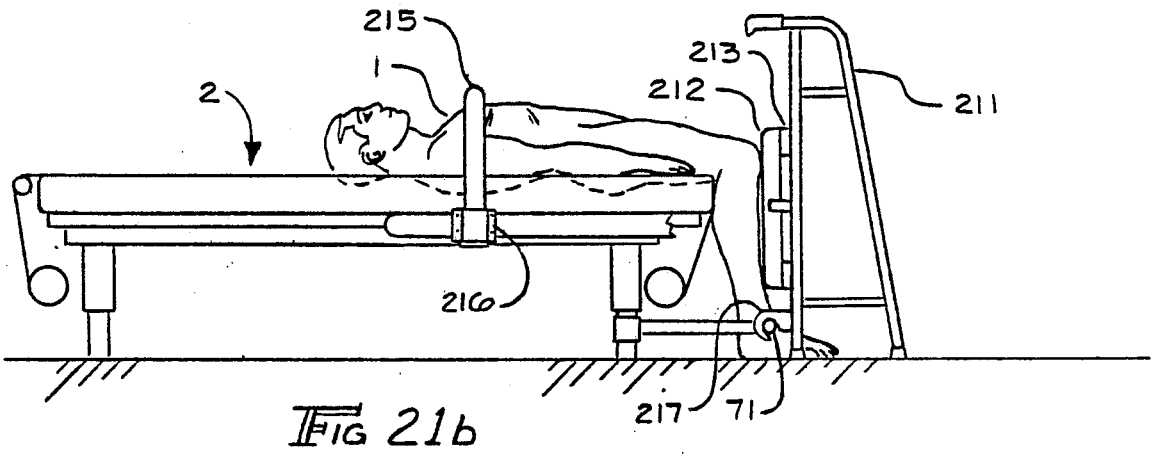
Figure 21C:
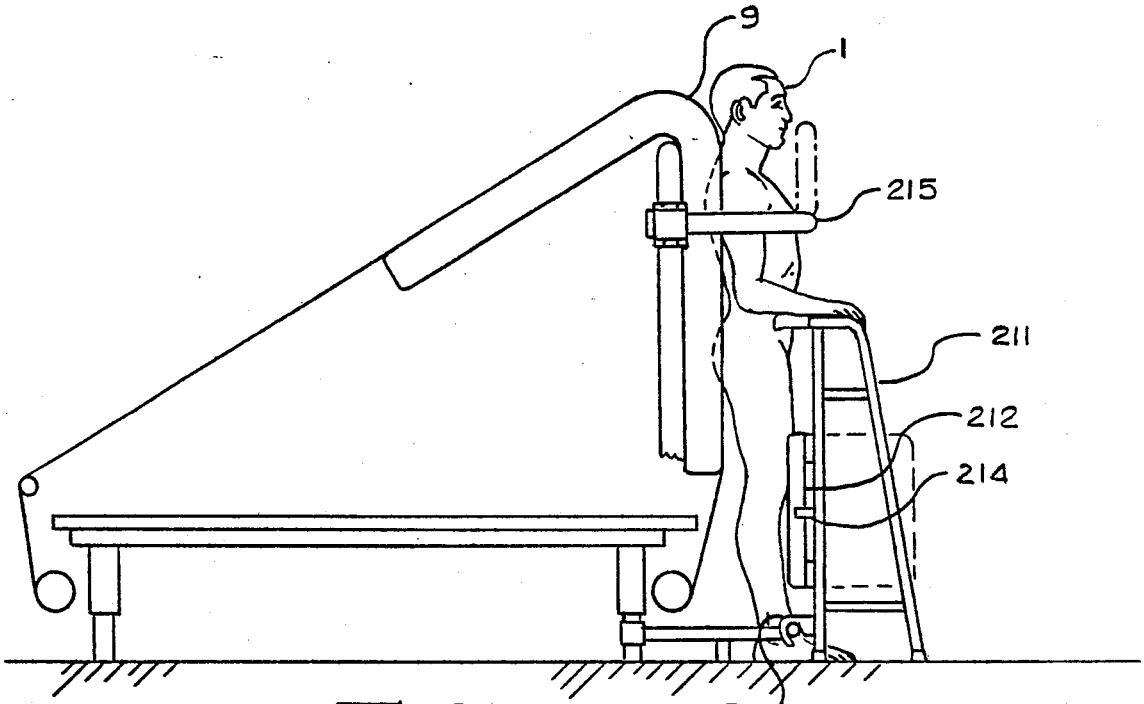

FIGS. 21*a* through 21*c* show schematically how a person can be transferred to a standing position at the end of the bed.

FIG. 21*a* shows the person 1 reclining on the mattress 9. Optional safety supports 215 are shown mounted in support mounts 216 attached to mattress lift arms 17 on each side of the mattress. Supports 215 are slidable and can be rotated 90 degrees in mounts 216.

FIG. 21*b* shows a walker 211 which has been locked by latch 217 to toothed shaft 71 on the bed 2. The person 1 has been transported as described previously, to the end of bed 2 and his knees are about to reach knee brace 212, mounted by hinges 213 on walker 211. Safety supports 215 have been slid up and rotated 90 degrees in support mount 216 so as to extend across the person 1.

FIG. 21*c* shows the person 1 standing at the walker 211 after he has been lifted up by the mattress 9, with his knees and legs supported by the knee brace 212. Safety supports 215, which prevent him from falling over until he has grasped the walker 211, can now be rotated up as shown in dashed lines. He is then ready to release latch 214 to allow knee brace 212 to pivot out to the side, as shown in dashed lines. Then, after releasing latch 217, he can walk away from the bed.

Figure 22A:
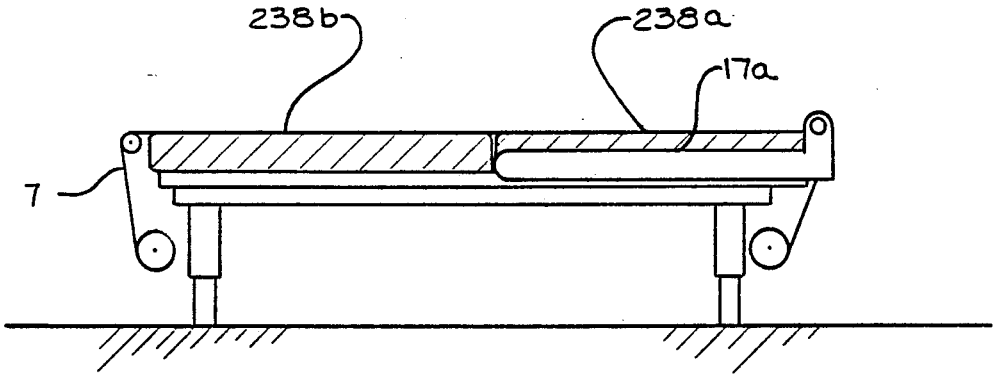
FIGS. 22*a* and 22*b* show schematically an arrangement for lifting one section of a split mattress, with the lift arms down and up respectively.
Figure 22B:
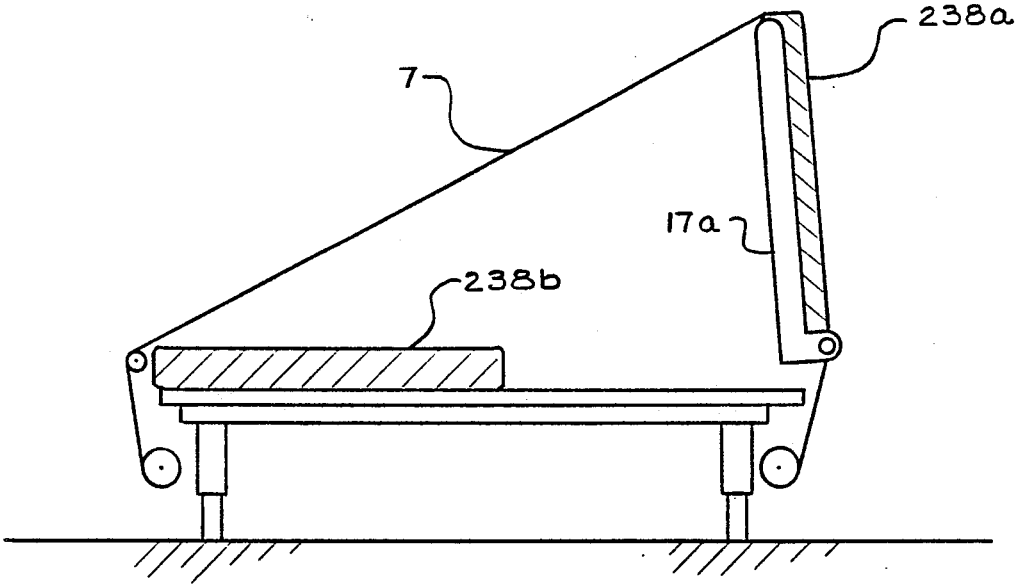

FIGS. 22*a* and 22*b* show an alternate arrangement of the mattress-lifting arrangement using a split mattress with a front section 238*a* and a rear section 238*b* supporting transport sheet 7. Mattress front section 238*a* is supported and lifted by lift arms 17*a* and 17*b* as shown in FIG. 9 and explained previously. Mattress rear section 238*b* is not lifted.

Figure 23A:
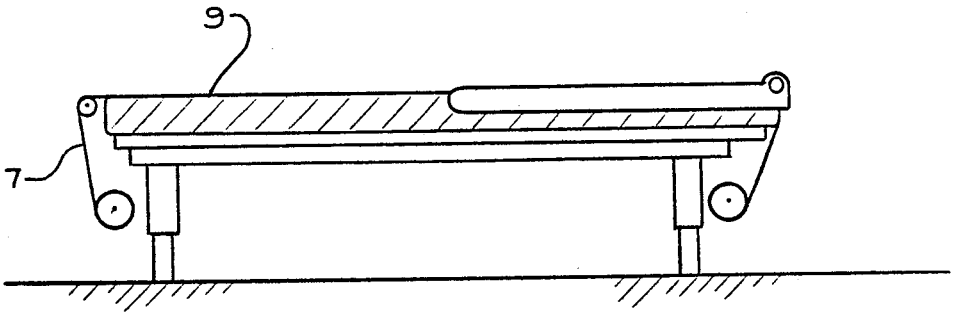
FIGS. 23*a* and 23*b* shows schematically an arrangement for lifting a transport sheet, with the lift arms down and up, respectively.
Figure 23B:
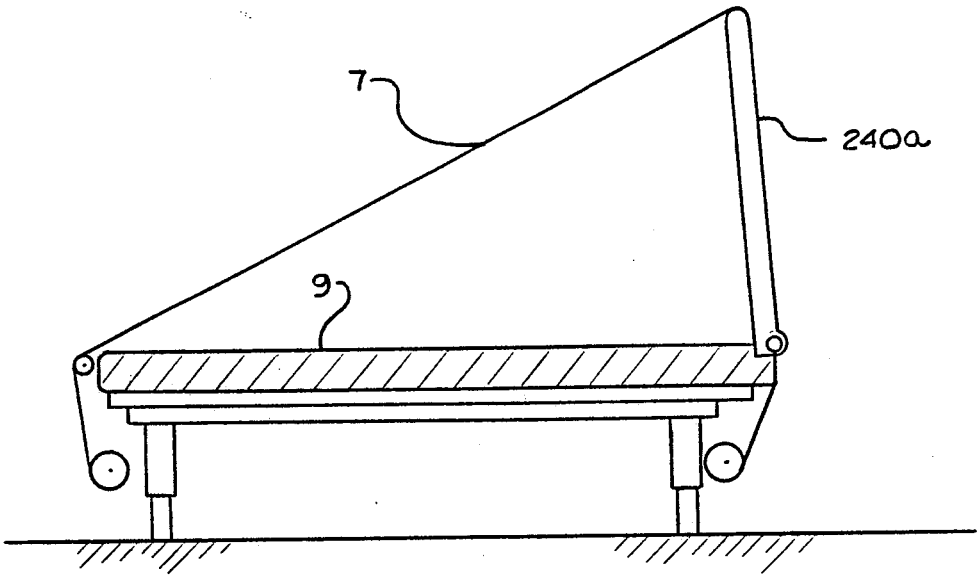

FIGS. 23*a* and 23*b* are schematic views of another alternate lifting arrangement, in which lift arms 240*a* and 240*b*, driven as shown in FIG. 9, raise sheet 7 directly without lifting mattress 9. FIGS. 23*a* and 23*b* show the lift arms down and up, respectively.

Figure 23C:
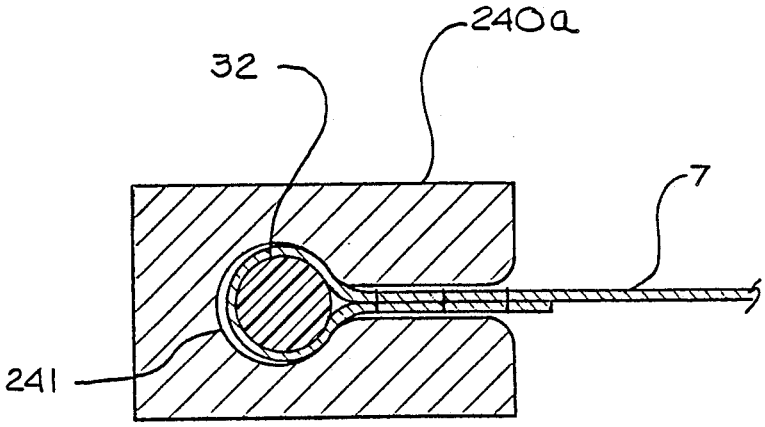
FIG. 23*c* is a cross-sectional view through a lift arm, showing a method of supporting the transport sheet using a thickened hem in a shaped groove.

FIG. 23*c* is a cross-section view through lift arm 240*a* showing a shaped groove 241 through which thickened hem 32 of sheet 7 slides and is guided when the lift arm is down, and by which sheet 7 is supported when lift arm 240*a* is lifted.

Figure 23D:
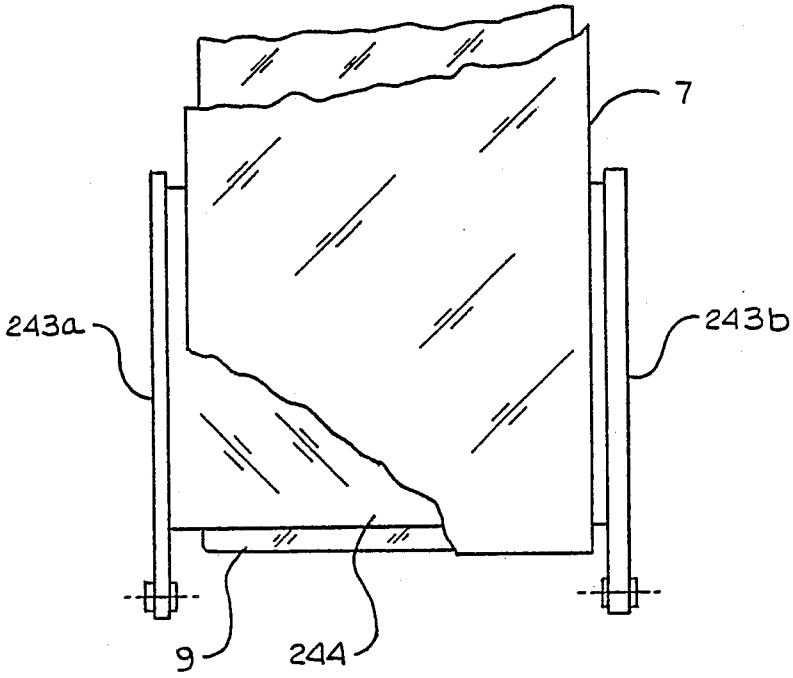
FIG. 23*d* is a plan-view view schematic showing a support sheet used for lifting a transport sheet.

FIG. 23*d* is a schematic plan view showing an alternative configuration for lifting transport sheet 7, by means of support sheet 244 stretched between lift arms 243*a* and 243*b* under transport sheet 7 and over mattress 9.

Figure 24:
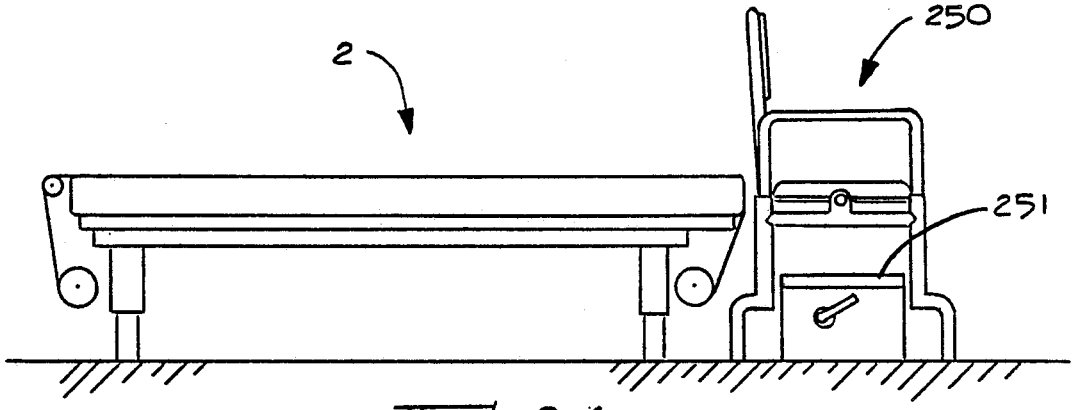
FIG. 24 is a schematic view of a transfer arrangement using a fixed chair without wheels, and a toilet.

FIG. 24 shows schematically an invalid transfer arrangement using a fixed chair 250 similar to the wheelchair in FIG. 3, except without wheels, positioned at the end of bed 2. An optional toilet 251 is positioned under the chair. The operation of the arrangement is the same as with a wheelchair, except that the chair 250 is not moved.

I claim:

1. An invalid transfer arrangement comprising: a wheelchair removably positioned at the end of a bed; said wheelchair having wheels, a frame, a back rest, a leg rest, and a seat; said leg rest being movably connected to said frame; said leg rest being movable between a seating position sloping down from said seat and a substantially level transfer position over said seat; said bed having a mattress adjacent to and at substantially the height of the leg rest transfer position; a transport sheet extending across said mattress; roller means for moving said transport sheet and transporting a reclining person across the mattress and partly onto said leg rest when said leg rest is in said transfer position; drive means for moving said leg rest form said transfer position to said seating position and thereby moving said reclining person partly onto the seat; lift means for raising said reclining person to a sitting position on the seat; said back rest being insertable on said frame behind the person.

2. An invalid transfer arrangement as defined in claim 1, wherein said transport sheet has thickened edges; guide means engaging said thickened edges for spreading the transport sheet across said mattress and directing said transport sheet onto the rollers; said rollers being larger in diameter at substantially center regions of said rollers than at ends of said rollers for pulling center of the sheet and rolling up said thickened edges.

3. An invalid transfer arrangement as defined in claim 1, wherein said transport sheet has thickened edges; guide means engaging said thickened edges; said guide means comprising two guide rollers, one of said rollers being above said sheet and one of said rollers being below said sheet; said transport sheet passing through a narrow gap between said guide rollers; said thickened edge rolling around said rollers; said rollers being shaped to conform to a thickened edge and hold said edge in position.

4. An invalid transfer arrangement as defined in claim 1, wherein said transport sheet has thickened edges; guide means engaging said thickened edges; said guide means comprises an edge support having a groove with a narrow outer portion through which said sheet slides and a wider inner portion through which a thickened edge of said sheet slides and is held in position.

5. An invalid transfer arrangement comprising: a wheel chair removably positioned at the end of a bed; said wheelchair having wheels, a frame, and removable back rest; a seat, and a leg rest movably attached to said frame; said leg rest being movable between a seating position sloping down from said seat and substantially level transfer position over said seat; said seat having connections to said frame and said leg rest such that said seat is substantially horizontal when the leg rest is in said seating position and in said transfer position; said seat being tilted from the horizontal when the leg rest is in other positions; said bed having a mattress adjacent to and at substantially the height of the leg rest transfer position; a transport sheet extending across the mattress; roller means for moving the transport sheet and transporting a reclining person across the mattress and onto said leg rest when said leg rest is in said transfer position; drive means for moving said leg rest between said transfer position and seating position and thereby moving the person partly onto the seat; lift means for raising the person to a sitting position on the wheelchair; said back rest being insertable on the frame behind the person.

6. An invalid transfer arrangement comprising a wheelchair removably positioned at the end of a bed; said wheelchair having wheels, a frame, a removable back rest, and a seat; a movable leg rest attached through pivots and links to said frame; said leg rest being movable between a seating position sloping down from said seat and a substantially level transfer position over said seat; said bed having a mattress extending in vicinity of and at substantially the height of the leg rest transfer position; a transport sheet extending across said mattress; roller means for moving the transport sheet and transporting a reclining person across said mattress and partially onto the leg rest when said leg rest is in said transfer position; drive means for moving the leg rest from said transfer position to said seating position and transporting the reclining person partially onto the seat; with means for raising the reclining person to a sitting position on the seat; and a back rest removably insertable on said frame behind the person.

7. An invalid transfer arrangement comprising a wheelchair removably positioned at the end of a ed; said wheelchair having wheels, a frame and a removable back rest; a seat pivotable attached on opposite sides to the frame; a leg rest attached through links and pivots to the frame and to the seat such that said leg rest is movable between a seating position sloping down from said eat and substantially level transfer position over said seat; said seat being substantially horizontal when the leg rest is in said seating position and in said transfer position and said seat is tilted from the horizontal when the leg rest is in other positions; said bed having a mattress in vicinity of and substantially the height of the leg rest transfer position; a transport sheet extending across said mattress; roller means for moving the transport sheet and transporting a reclining person across said mattress and partially onto the leg rest when said leg rest is in said transfer position; drive means for moving the leg rest from said transfer position to said seating position and transporting the reclining person partially onto the seat; lift means for raising the reclining person to a sitting position on the seat; said back rest being insertable on said frame behind the person.

8. An invalid transfer arrangement as defined in claim 7, wherein said seat has a front part attached to each side of said frame by pivots; said seat having a rear part hinged to the front part of the seat so that the two parts form a horizontal seating surface; a leg rest hinged to the front part of said seat; links on each side of the wheelchair attached by pivots to said leg rest and to said frame; said leg rest being movable from a position in front of the wheelchair to a position above and overlapping said seat, the front part of said seat rotating concurrently 180 degrees and the rear part of said seat rotating concurrently 30 degrees to a fixed support; a foot rest adjustably attached to said leg rest; a seat lock allowing seat rotation and leg rest motion when released; said front and rear parts of said seat being removable and replaceable by corresponding parts of a toilet seat which are connected by a hinge.

9. An invalid transfer arrangement as defined in claim 7, wherein said seat is attached to each side of said frame by pivots; a leg rest connected by links and pivots near top and bottom of said leg rest to pivots on said frame; said leg rest thereby being movably form a normal position at front of the wheelchair to a substantially level transport position overlapping said seat; said seat being constrained by fixed supports to pivot from a horizontal position to substantially 30 degrees elevation as said leg rest moves up; said seat being forced to pivot back to horizontal by a coupling to said leg rest as said leg rest moves further to its transport position; and a releasable lock to hold said seat and leg rest in normal positions for sitting.

10. An invalid transfer arrangement as defined in claim 7, and including lift means to raise said transport sheet without raising said mattress; said lift means having lift arms on each side of said mattress; said lift arms being connected by a supporting sheet of material underneath said transport sheet; said lift arms being connected to an electric motor for raising and lowering said transport sheet and a person reclining thereon.

11. An invalid transfer arrangement as defined in claim 7, including lift means for raising said transport sheet without raising said mattress; said lift means having lift arms on each side of said mattress: each lift arm having a groove with a narrow outer portion through which said transport sheet can slide and a large inner portion in which a thickened edge of said transport sheet can slide and is captured; said lift arms being connected to electric drive means for raising and lowering said lift arms and thereby raising and lowering said transport sheet and a person reclining thereon.

12. An invalid transfer arrangement as defined claim 5, wherein said leg rest is movable, from an inclined position in front of said seat to a substantially horizontal position over said seat; said seat being connected by pivots and links to said frame and said leg rest, whereby upon motion of said leg rest from said inclined position to said level position said seat moves down under said leg rest.

13. An invalid transfer arrangement comprising a wheelchair removably held in position at the end of a bed by a latch; said wheelchair having wheels and a frame with two sides; a removable back rest; a seat pivotably attached to each side of the frame; a leg rest attached through a hinge to the seat and pivotably connected through links to the sides of the frame such that the leg rest is movable between a seating position sloping down from the seat and a substantially level transfer position over the seat; said seat rotating from a normal horizontal position to an inverted horizontal position when the leg rest is moved form said seating position to said transfer position; said bed having a mattress in vicinity and at substantially the height of said leg rest in said transfer position; a transport sheet on which a person may recline extending across the mattress between rollers in vicinity of head and foot ends of the bed; said transport sheet being attached and partially rolled up on said rollers; sheet driving means on the bed for rolling said transport sheet onto one of said rollers and off another said rollers and thereby moving said transport sheet across the mattress and transporting a reclining person across the bed and partly onto the leg rest when said leg rest is in said transfer position; an electric motor coupled to the leg rest for moving the leg rest from said transfer position to said seating position and moving said reclining person partly onto said seat; lift means for elevating part of the mattress and raising said reclining person to a sitting position on the seat; control means for regulating operation of said transfer arrangement; and means for inserting the back rest behind the person.

14. An invalid transfer system as defined in claim 13, wherein said transport sheet has thickened edges; said rollers being smaller in diameter at substantially their ends than at substantially their centers for rolling up said transferring sheet.

15. An invalid transfer system as defined in claim 13, including a mattress cover with low friction top and end surface, said transport sheet having a low friction bottom surface to slide over said mattress cover.

16. An invalid transfer system as defined in claim 13, wherein said transport sheet has a thickened edge along each side; said guide means comprising two rollers with co-aligned vertical of axes; said rollers being positioned substantially at an edge of said transport sheet, one roller being above and one roller being below said transport sheet; said transport sheet passing through a narrow gap between said rollers; said thickened edge rolling around said rollers and being held in position by said rollers.

17. An invalid transfer system as defined in claim 13, including an idler roller mounted substantially at one end of said mattress for supporting and guiding said transport sheet.

18. An invalid transfer system as defined in claim 13, wherein said mattress end support means allows an end of the mattress to flex vertically but not longitudinally and prevents flexure at the edges.

19. An invalid transfer system as defined in claim 13, including a bed frame and mattress end support means; said mattress having an end extending beyond said bed frame and onto said mattress end support means; said mattress end support means comprising a substantially thin support strip of stiff flexible material with ends slidably mounted to edges of the bed frame by bolts through slots in said support strip said support strip holding up the edges of said mattress while allowing the mattress end to flex vertically but not longitudinally and preventing flexure at the edges.

20. An invalid transfer system as defined in claim 13, wherein said lift means compries lift arms attached to a supporting member underneath said mattress; an electric motor coupled to said lift arms for raising and lowering said mattress.

21. An invalid transfer system as defined in claim 13, wherein said lift means comprises a lift arm on each side of said bed; a lift arm being connected by a cable to a windlass; said windlass being driven by electric drive means for raising and lowering said lift arm.

22. An invalid transfer system as defined in claim 10, including a latch on said wheelchair; said latch engaging a horizontal shaft on said bed with coupling means for transmitting power from said bed to said wheelchair.

23. An invalid transfer system as defined in claim 13, wherein said seat is coupled to a toothed belt held by said latch in contact and engagement with a notched shaft rotatably attached to said bed; said notched shaft being coupled to electric motor means for rotating said seat.

24. An invalid transfer system as defined in claim 13, wherein said seat includes a detachable seat cushion which is interchangeable with a detachable toilet seat; and a chamber pot removably installed in said wheel chair.

25. An invalid transfer system as defined in claim 13 wherein said removable back rest is detachable and separable from said wheelchair.

26. An invalid transfer system as defined n claim 13, wherein said removable back rest is detachable from one support arm and movably pivoted on another support arm for providing free access for transferring a person.

27. An invalid transfer system as defined in claim 13, including means for adjusting length of said leg rest.

28. An invalid transfer system as defined in claim 13, wherein said control means comprises a control unit having control switches, logic and switching circuitry electrically connected to limit switches, drive motors, and clutches.

29. An invalid transfer system as defined in claim 13 wherein said sheet driving means and lift means include separate motors to drive mattress lift arms and rollers at head and foot ends of the bed.

30. An invalid transfer system as defined in claim 13, wherein said sheet driving means and lift means include a single motor coupled through separate clutches to rollers near head and foot ends of the bed and to mattress lift arms.

31. An invalid transfer system as defined in claim 13, wherein bed sheets on which a person may lie are removably attached to said transport sheet.

32. An invalid transfer system as defined in claim 13, wherein bed sheets on which a person may lie are removably attached to said transport sheet by touch-and-close, pull-and-release material such as that commercially availably under the trade name VELCRO.

33. An invalid transfer system as defined in claim 13, wherein said mattress is divided into two separate parts; a first part of said mattress extending to the head-end of the bed; a second part, extending to the foot-end of the bed and being rotatable by said lift means; said lift means comprising lift arms connected by a supporting member under said second part and being connected to an electric motor for raising a person to a seated position on said seat.

34. An invalid transfer system as defined in claim 13, wherein said wheelchair comprises a fixed chair with a seat; and a toilet below the chair seat.

35. An invalid transfer system as defined in claim 13, including a pad removably attached to said transport sheet.

36. An invalid transfer arrangement comprising a wheelchair removably held in position at the end of a bed by a latch; said wheelchair having wheels and a frame with two sides; a removable back rest; a rotatable seat attached to each side of the frame by pivots; a leg rest attached through a hinge to the seat to he seat and pivotably connected through links to the sides of the frame such that the leg rest is movable between a seating position sloping down from the seat and a substantially level transfer position over the seat; said seat rotating from a normal horizontal position to an inverted horizontal position when the leg reset is moved from said seating position to said transfer position; said bed having a mattress in vicinity of and at substantially the height of said leg rest in said transfer position; a transport sheet on which a person may recline extending across the mattress between rollers in vicinity of head and foot ends of the bed; said transport sheet being attached and partially rolled up on said rollers; sheet driving means on the bed for rolling said transport sheet onto one of said rollers and off another said rollers and thereby moving said transport sheet across the mattress sand transporting a reclining person across the bed and partly onto the leg rest when said leg rest is in said transfer position; lift means for lifting part of the mattress and raising the reclining person to a sitting position; coupling means between the seat and lift means for driving the leg rest and seat to said seating position and moving the person onto the seat when said mattress is being lifted; control means for regulating operation of said transfer arrangement; and means for inserting the back rest behind the person.

37. An invalid transfer system as defined in claim 36, including spring means for pushing up said leg rest; and a seat lock to enable seat rotation when said seat lock is released.

38. An invalid transfer system as defined in claim 36, including a latch on said wheelchair; said latch partially enclosing and holding said wheelchair locked to a notched horizontal shaft attached rotatably to an end of said bed at the front thereof; said notched horizontal shaft being coupled to said lift means and rotating when said lift means rotates in raising and lowering said mattress; said notched horizontal shaft engaging and driving a double-sided toothed belt; said toothed belt being held in close contact and in engagement with said notched shaft by said latch; said toothed belt being coupled also to said seat for rotating said seat when said mattress is raised or lowered; said latch and wheelchair being releasable by depressing said notched shaft.

39. An invalid transfer system as defined in claim 36, including a latch on said wheelchair with a coupling to said mattress lift means whereby said latch is engaged only when said mattress is lifted more than a predetermined amount; said latch, when engaged, stopping said seat from elevating past a predetermined angle; seat rotation toward a nominal sitting position angle being independent of said latch.

40. An invalid transfer system as defined in claim 36, including a rotating seat coupled through a chain and sprockets to a first wheel chair arm pivotably mounted near the back of said frame; said first arm being normally latched in an upright position; said first arm, when unlatched ,being pushed by spring means against said mattress; said lift means raising said mattress and first arm and forcing said seat to rotate correspondingly; a second arm vertically mounted to said frame and pivotably supporting one side of said back rest; said back rest having another side removably attachable to said first arm.

41. An invalid transfer system as defined in claim 37, wherein said seat is rotatable and connected through an attached slotted coupling to a drive shaft; said drive shaft being connected to and rotating with a first arm pivotably mounted to said frame, said first arm being normally held in an upright position by a first latch; said first latch allowing a spring to force said first arm against said mattress upon release of said first latch; said first arm and said connecting drive shaft rotating when said mattress is raised by said lift means; a pin in said drive shaft pushing against an end of a slot in said coupling and thereby rotating the seat to a horizontal position against an opposing spring; said pin rotating toward the middle of said slot when said mattress lift means is lowered and, thereby freeing said seat to rotate without interference from said pin; seat rotation being limited by an engaged latch which prevents seat rotation beyond a predetermined angle; said latch allowing rotation of said seat in opposite direction; said latch being disengaged by lowering said first arm through coupling means to said first arm.

42. An invalid transfer system as defined in claim 36, including a back arm pivotably mounted to the frame of said wheelchair and normally latched in an upright position; said back arm when unlatched being forced against the mattress by a spring; said back arm following said mattress as said mattress is raised and lowered for raising said back arm and thereby moving an attached link; said link; said link engaging and rotating said seat against a spring to a horizontal position; lowering said back arm disengaging said link and allowing said seat to rotate freely.

43. An invalid transfer arrangement comprising; a wheelchair removably positioned at the end of a bed; said wheelchair having a leg rest and a seat; said bed having a mattress adjacent to and at substantially the height of the seat; a transport sheet extending across the mattress; roller means for moving said transport sheet and transporting a reclining person across the mattress and partly onto said seat and leg rest; sand lift means for raising said reclining person to a sitting position on the seat.

44. An invalid transfer arrangement as defined in claim 43, wherein part of said mattress is movable by said lift means for raising said reclining person to a sitting position on said seat.

45. An invalid transfer system as defined in claim 43, wherein part of said transfer sheet is movable by said lift means for raising said reclining person to a sitting position on said sheet.

46. An invalid transfer arrangement comprising: a wheelchair removably positioned at the end of a bed; said wheelchair having a frame, a leg rest, a back rest and a seat; said bed having a mattress adjacent to at substantially the height of the seat; a transport sheet extending across the mattress; roller means for moving said transport sheet and transporting a reclining person across the mattress and partly onto said seat and leg rest; lift means for elevating part of said mattress and raising said reclining person to a sitting position on the seat; said back rest being insertable on the frame behind the person.

* * * * *